US009096962B2

(12) United States Patent
Shimizu et al.

(10) Patent No.: US 9,096,962 B2
(45) Date of Patent: Aug. 4, 2015

(54) SEWING MACHINE, EMBROIDERY UNIT, AND NON-TRANSITORY COMPUTER-READABLE MEDIUM STORING SEWING MACHINE CONTROL PROGRAM

(71) Applicants: Akie Shimizu, Nagoya (JP); Satoru Makino, Nagoya (JP); Yuki Ihira, Kakamigahara (JP); Daisuke Abe, Nagoya (JP); Yoshinori Nakamura, Toyohashi (JP); Satoru Ichiyanagi, Nagoya (JP); Yutaka Nomura, Anjo (JP)

(72) Inventors: Akie Shimizu, Nagoya (JP); Satoru Makino, Nagoya (JP); Yuki Ihira, Kakamigahara (JP); Daisuke Abe, Nagoya (JP); Yoshinori Nakamura, Toyohashi (JP); Satoru Ichiyanagi, Nagoya (JP); Yutaka Nomura, Anjo (JP)

(73) Assignee: BROTHER KOGYO KABUSHIKI KAISHA, Nahoya (JP)

( * ) Notice: Subject to any disclaimer, the term of this patent is extended or adjusted under 35 U.S.C. 154(b) by 289 days.

(21) Appl. No.: 13/788,893

(22) Filed: Mar. 7, 2013

(65) Prior Publication Data

US 2013/0233217 A1 Sep. 12, 2013

(30) Foreign Application Priority Data

Mar. 12, 2012 (JP) ..... 2012-055103

(51) Int. Cl.
*D05B 19/12* (2006.01)
*D05C 5/02* (2006.01)

(52) U.S. Cl.
CPC . *D05B 19/12* (2013.01); *D05C 5/02* (2013.01)

(58) Field of Classification Search
CPC ..... D05C 9/04; D05C 9/22; D05C 5/02; D05B 19/02–19/10
USPC ..... 700/136–138; 112/102.5
See application file for complete search history.

(56) References Cited

U.S. PATENT DOCUMENTS

| | | | | |
|---|---|---|---|---|
| 3,966,331 | A | 6/1976 | Inuiya | |
| 4,712,497 | A * | 12/1987 | Nomura et al. | 112/315 |
| 4,998,489 | A | 3/1991 | Hisatake et al. | |
| 5,072,680 | A * | 12/1991 | Nakashima | 112/445 |
| 5,195,451 | A * | 3/1993 | Nakashima | 112/102.5 |
| 5,553,559 | A * | 9/1996 | Inoue et al. | 112/102.5 |
| 5,855,176 | A * | 1/1999 | Takenoya et al. | 112/102.5 |

(Continued)

FOREIGN PATENT DOCUMENTS

| | | |
|---|---|---|
| JP | S61-131787 A | 6/1986 |
| JP | S64-040386 | 3/1989 |

(Continued)

OTHER PUBLICATIONS

Feb. 4, 2014 Office Action issued in Japanese Patent Application No. 2012-055103 (with English Translation).

(Continued)

*Primary Examiner* — Danny Worrell
(74) *Attorney, Agent, or Firm* — Oliff PLC

(57) ABSTRACT

A sewing machine includes at least one detecting portion, a processor, and a memory. The at least one detecting portion is configured to detect an ultrasonic wave that has been transmitted from a transmission source. The memory is configured to store computer-readable instructions that instruct the sewing machine to execute steps including identifying a position of the transmission source of the ultrasonic wave based on information pertaining to the ultrasonic wave that has been detected by the at least one detecting portion, and controlling sewing based on the position of the transmission source that has been identified.

14 Claims, 18 Drawing Sheets

(56) References Cited

U.S. PATENT DOCUMENTS

| | | | | |
|---|---|---|---|---|
| 6,000,350 | A | 12/1999 | Koike et al. | |
| 6,167,822 | B1 * | 1/2001 | Miyasako et al. | 112/102.5 |
| 6,871,606 | B2 * | 3/2005 | Schweizer | 112/475.02 |
| 6,883,446 | B2 | 4/2005 | Koerner | |
| 7,079,917 | B2 | 7/2006 | Taguchi et al. | |
| 7,155,302 | B2 * | 12/2006 | Muto et al. | 700/138 |
| 7,373,891 | B2 | 5/2008 | Koerner | |
| 7,854,207 | B2 * | 12/2010 | Kuki et al. | 112/102.5 |
| 8,061,286 | B2 | 11/2011 | Hirata et al. | |
| 8,074,590 | B2 | 12/2011 | Bentley | |
| 8,286,568 | B2 * | 10/2012 | Tokura | 112/102.5 |
| 8,301,292 | B2 * | 10/2012 | Tokura | 700/138 |
| 8,528,491 | B2 | 9/2013 | Bentley | |
| 8,567,329 | B2 | 10/2013 | Kishi | |
| 8,763,542 | B2 | 7/2014 | Abe et al. | |
| 2004/0182295 | A1 | 9/2004 | Pfeifer | |
| 2009/0188413 | A1 | 7/2009 | Hirata et al. | |
| 2011/0048299 | A1 * | 3/2011 | Tokura | 112/102.5 |
| 2011/0226170 | A1 * | 9/2011 | Tokura | 112/470.05 |
| 2012/0000249 | A1 | 1/2012 | Hamada | |
| 2012/0111249 | A1 * | 5/2012 | Sekine | 112/102.5 |
| 2012/0210925 | A1 | 8/2012 | Koga et al. | |
| 2013/0233217 | A1 | 9/2013 | Shimizu et al. | |
| 2013/0233219 | A1 | 9/2013 | Nakamura et al. | |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2014/0000498 | A1 | 1/2014 | Yamanashi et al. | |

FOREIGN PATENT DOCUMENTS

| | | |
|---|---|---|
| JP | A-06-000264 | 1/1994 |
| JP | A-2007-128120 | 5/2007 |
| JP | A-2009-172123 | 8/2009 |

OTHER PUBLICATIONS

Jul. 30, 2014 Office Action issued in U.S. Appl. No. 13/788,903.
U.S. Appl. No. 13/788,903, filed Mar. 7, 2013 in the name of Yoshio Nishimura et al.
U.S. Appl. No. 13/788,928, filed Mar. 7, 2013 in the name of Yoshinori Nakamura et al.
U.S. Appl. No. 13/789,046, filed Mar. 7, 2013 in the name of Daisuke Abe et al.
U.S. Appl. No. 13/789,061, filed Mar. 7, 2013 in the name of Yoshio Nishimura et al.
U.S. Appl. No. 13/788,979, filed Mar. 7, 2013 in the name of Yutaka Nomura et al.
Mar. 4, 2014 Office Action issued in U.S. Appl. No. 13/788,979.
Feb. 26, 2015 Office Action issued in U.S. Appl. No. 13/789,061.
Mar. 3, 2015 Office Action issued in Japanese Application No. 2014-059717.

* cited by examiner

SEWING MACHINE, EMBROIDERY UNIT, AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2012-055103 filed Mar. 12, 2012, the content of which is hereby incorporated herein by reference.

BACKGROUND

The present disclosure relates to a sewing machine, an embroidery unit, and a non-transitory computer-readable medium storing a sewing machine control program that allow sewing in a position specified on a work cloth.

A sewing machine is known that can easily set a sewing position and a sewing angle, at which a desired embroidery pattern is to be sewn, on a work cloth. For example, a known sewing machine includes an imaging portion. After a user affixes a marker to a specified position on the work cloth, an image of the marker may be captured by the imaging portion. The sewing machine may automatically set the sewing position and the sewing angle of the embroidery pattern based on the captured image of the marker.

SUMMARY

However, with the above-described sewing machine, it may be necessary to affix the marker to the work cloth. Further, after the sewing machine has set the sewing position and the sewing angle of the embroidery pattern, the user may need to remove the marker affixed to the work cloth before sewing is performed. Therefore, the operation may be troublesome for the user.

Embodiments of the broad principles derived herein provide a sewing machine, an embroidery unit, and a non-transitory computer-readable medium storing a sewing machine control program that enable easily setting a position, on a work cloth, at which sewing is performed.

Embodiments provide a sewing machine that includes at least one detecting portion, a processor, and a memory. The at least one detecting portion is configured to detect an ultrasonic wave that has been transmitted from a transmission source. The memory is configured to store computer-readable instructions that instruct the sewing machine to execute steps including identifying a position of the transmission source of the ultrasonic wave based on information pertaining to the ultrasonic wave that has been detected by the at least one detecting portion, and controlling sewing based on the position of the transmission source that has been identified.

Embodiments also provide an embroidery unit that can be attached to and detached from a bed of a sewing machine, and to which an embroidery frame can be attached, and that is configured to move the embroidery frame, the embroidery frame being configured to hold a work cloth. The embroidery unit includes at least one detecting portion and a notifying portion. The at least one detecting portion is configured to detect an ultrasonic wave that has been transmitted from a transmission source. The notifying portion is configured to notify the sewing machine of a detection timing at which the ultrasonic wave was detected by the at least one detecting portion. The embroidery unit is configured to move the work cloth based on a position of the transmission source of the ultrasonic wave that has been identified by the sewing machine based on the detection timing that has been notified by the notifying portion.

Embodiments further provide a non-transitory computer-readable medium storing a control program executable on a sewing machine. The program includes computer-readable instructions, when executed, to cause the sewing machine to perform the step of identifying, based on information pertaining to an ultrasonic wave that has been detected by at least one detecting portion of the sewing machine, a position of a transmission source of the ultrasonic wave. The at least one detecting portion is configured to detect the ultrasonic wave that has been transmitted from the transmission source. The program further includes computer-readable instructions, when executed, to cause the sewing machine to perform the step of controlling sewing based on the position of the transmission source that has been identified.

BRIEF DESCRIPTION OF THE DRAWINGS

Embodiments will be described below in detail with reference to the accompanying drawings in which.

DETAILED DESCRIPTION

First Embodiment

Figure 1:
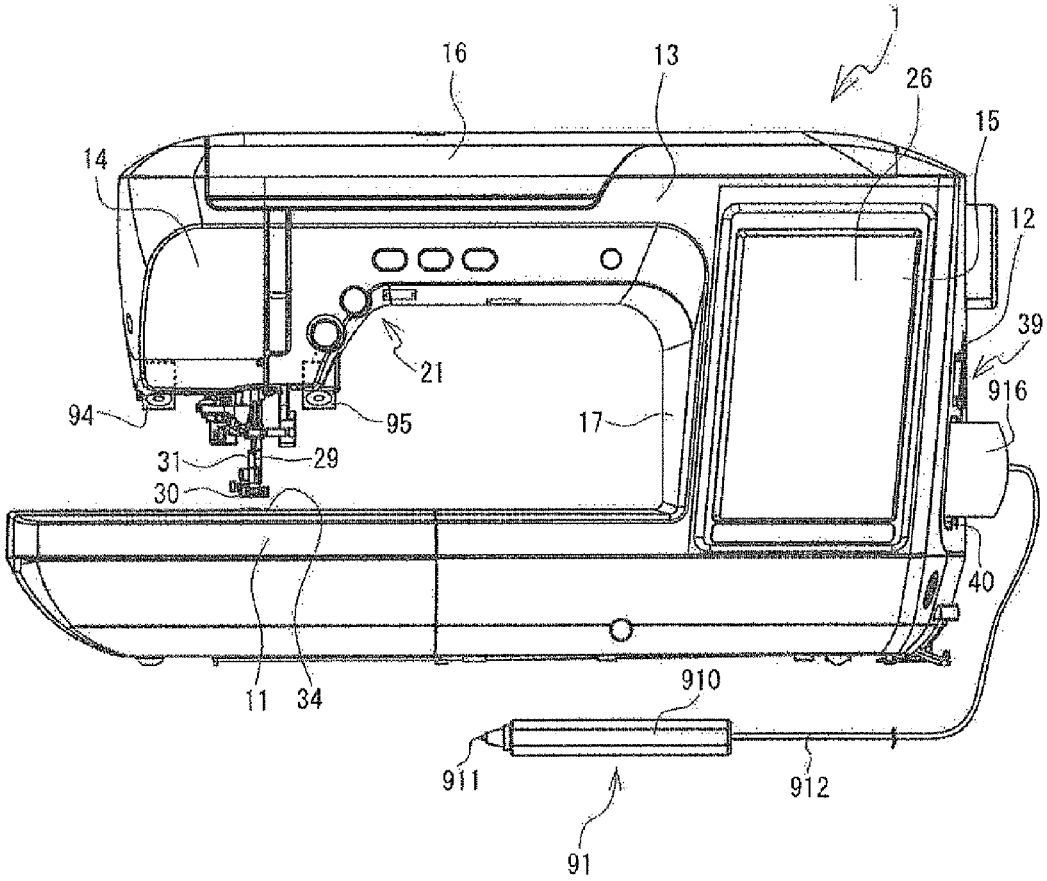
FIG. 1 is a front view of a sewing machine according to a first embodiment.

Hereinafter, a first embodiment will be explained with reference to the drawings. A configuration of a sewing machine 1 will be explained with reference to FIG. 1. The near side, the far side, the upper side, the lower side, the left side, and the right side of FIG. 1 are respectively defined as the front side, the rear side, the upper side, the lower side, the left side, and the right side of the sewing machine 1. Specifically, a direction in which a pillar 12, which will be described below, extends is the up-down direction of the sewing machine 1. The longitudinal direction of a bed 11 and an arm 13 is the left-right direction of the sewing machine 1. A surface on which a plurality of operation switches 21 are arranged is a front face of the sewing machine 1.

The sewing machine 1 includes the bed 11, the pillar 12, the arm 13, and a head 14. The bed 11 is a base portion of the sewing machine 1 and extends in the left-right direction. The pillar 12 extends upward from the right end of the bed 11. The arm 13 extends to the left from the upper end of the pillar 12 such that the arm 13 faces the bed 11. The head 14 is provided on the left end of the arm 13. A needle plate 34 is disposed on a top surface of the bed 11. A feed dog, a feed mechanism, a shuttle mechanism (which are not shown in the drawings) and a feed adjustment motor 83 (refer to FIG. 5) are provided below the needle plate 34 (namely, inside the bed 11). The feed dog may be driven by the feed mechanism, and may feed a work cloth 100 (refer to FIG. 6) by a specified feed distance. The feed adjustment motor 83 may adjust the feed distance of the feed dog.

A needle bar mechanism (not shown in the drawings), a needle bar swinging motor 80 (refer to FIG. 5) and the like are provided on the head 14. The needle bar mechanism may drive a needle bar 29 in the up-down direction. A sewing needle (not shown in the drawings) may be attached to the needle bar 29. The needle bar swinging motor 80 may swing the needle bar 29 in the left-right direction. A receiver 94 is provided at the lower left end of the head 14, on the rear side of a lower surface of the head 14. A receiver 95 is provided at the lower right end of the head 14, on the rear side of the lower surface of the head 14. The receivers 94 and 95 are separated from each other in the left-right direction by the length of the head 14 in the left-right direction. The receivers 94 and 95 are configured to receive (detect) an ultrasonic wave. The receivers 94 and 95 have the same configuration. The receivers 94 and 95 will be described in more detail later.

A cover 16 to be opened and closed is provided on an upper portion of the arm 13. A thread spool (not shown in the drawings) may be accommodated underneath the cover 16, that is, substantially in a central portion within the arm 13. An upper thread (not shown in the drawings) may be wound around the thread spool. The upper thread may be supplied from the thread spool, through a thread hook (not shown in the drawings), to the sewing needle attached to the needle bar 29. The thread hook is provided on the head 14. The needle bar mechanism, which is provided inside the head 14, may drive the needle bar 29 such that the needle bar 29 is moved up and down. The needle bar mechanism may be driven by a sewing machine motor 79 (refer to FIG. 5). A presser bar 31 extends downward from the lower end of the head 14. A presser foot 30 may be detachably attached to the lower end of the presser bar 31. The presser foot 30 may press down the work cloth 100. The plurality of operation switches 21 are provided on a lower portion of the front face of the arm 13. The plurality of operation switches 21 include a start/stop switch.

A liquid crystal display (LCD) 15 is provided on the front face of the pillar 12. The LCD 15 may display images that include various types of items, such as a command, an illustration, a set value, a message, and the like. A touch panel 26 is provided on the front face of the LCD 15. A user may perform an operation of pressing the touch panel 26 using a finger or a dedicated touch pen. Hereinafter, this operation is referred to as a "panel operation". The touch panel 26 detects a position pressed by the finger, the dedicated touch pen, or the like, and the sewing machine 1 (more specifically, a CPU 61 that will be described below) determines the item that corresponds to the detected position. In this manner, the sewing machine 1 recognizes the selected item. By the panel operation, the user can select a pattern to be sewn and a command to be executed.

Connectors 39 and 40 are provided on a right surface of the pillar 12. An external storage device (not shown in the drawings), such as a memory card, can be connected to the connector 39. The sewing machine 1 may read out pattern data and various programs from the external storage device connected to the connector 39. A connector 916 may be connected to the connector 40. The connector 916 is coupled to a cable 912 that extends from an ultrasonic pen 91 (which will be described below). The sewing machine 1 may supply electric power to the ultrasonic pen 91 via the connector 40, the connector 916, and the cable 912, and may acquire an electrical signal output from the ultrasonic pen 91.

The ultrasonic pen 91 will be explained. The ultrasonic pen 91 includes a pen body 910 and a pen tip 911. The pen body 910 has a bar shape. The pen tip 911 is provided at the leading end of the pen body 910. A point of the pen tip 911 is sharp. Normally, the pen tip 911 is in a protruding position in which the pen tip 911 protrudes slightly to the outside from the pen body 910. On the other hand, when a force toward the pen body 910 acts on the pen tip 911, the pen tip 911 is inserted into the pen body 910. When the force acting on the pen tip 911 is released, the pen tip 911 returns to the original protruding position.

The ultrasonic pen 91 includes a switch 913 (refer to FIG. 5), a signal output circuit 914 (refer to FIG. 5), and an ultrasonic transmitter 915 (refer to FIG. 5) inside the pen body 910. The switch 913 is turned on and off in accordance with the position of the pen tip 911. The switch 913 may switch output states of the signal output circuit 914 and the ultrasonic transmitter 915.

When no force acts on the pen tip 911 (when the pen tip 911 is in the protruding position), the switch 913 is in an OFF state. When the switch 913 is in the OFF state, the signal output circuit 914 does not output an electrical signal and the ultrasonic transmitter 915 does not output an ultrasonic wave. On the other hand, when the user presses the pen tip 911 against an arbitrary position on the work cloth 100, a force acts on the pen tip 911. At this time, the pen tip 911 is inserted into the pen body 910 and the switch 913 is turned on. When the switch 913 is turned on, the signal output circuit 914 outputs an electrical signal to the sewing machine 1 via the cable 912, and the ultrasonic transmitter 915 transmits an ultrasonic wave.

As will be described in detail below, the sewing machine 1 can receive (detect) the ultrasonic wave transmitted from the ultrasonic pen 91 using the receivers 94 and 95. Based on the detected ultrasonic wave, the sewing machine 1 can identify a transmission source of the ultrasonic wave, namely, the position of the ultrasonic transmitter 915 provided in the ultrasonic pen 91. The sewing machine 1 can perform sewing based on the identified position. Thus, the user can specify an arbitrary position on the work cloth 100 by pressing the pen tip 911 of the ultrasonic pen 91 on the work cloth 100 (touching the work cloth 100 with the pen tip 911). As a result, it is possible to perform sewing in the specified position.

The receiver 94 will be explained with reference to FIG. 2 to FIG. 4. The receiver 95 has the same configuration as that of the receiver 94, so an explanation thereof is omitted. The lower left side, the upper right side, the upper left side, the lower right side, the upper side, and the lower side of FIG. 2 are respectively defined as the front side, the rear side, the left side, the right side, the upper side, and the lower side of the receiver 94.

Figure 2:
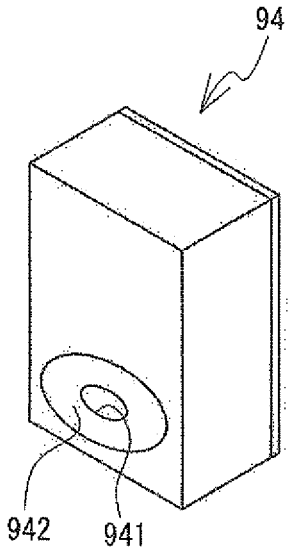
FIG. 2 is a perspective view of a receiver.
Figure 3:
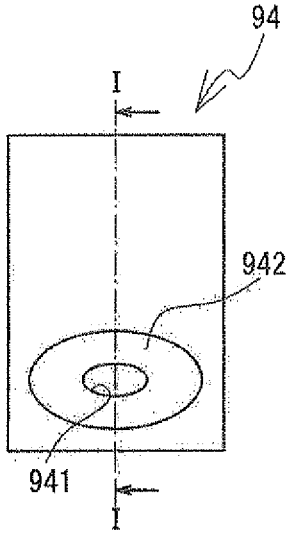
FIG. 3 is a front view of the receiver.
Figure 4:
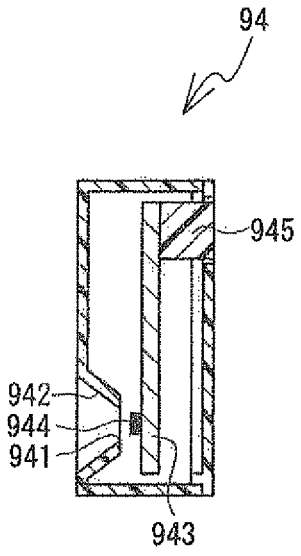
FIG. 4 is a cross-sectional view of the receiver taken along a line I-I shown in FIG. 3, as seen in an arrow direction.

As shown in FIG. 2 and FIG. 3, the receiver 94 has a rectangular parallelepiped shape that is slightly longer in the up-down direction. An opening 941 is provided in the center of a lower end portion of the front face of the receiver 94. The opening 941 has an elliptical shape that is long in the left-right direction. A wall 942 around the opening 941 is a tapered surface (an inclined surface) that becomes narrower from the outer side toward the inner side of a front surface of the receiver 94. As shown in FIG. 4, a substrate 943 and a microphone 944 are provided inside the receiver 94. The microphone 944 is provided, inside the receiver 94, behind the opening 941. A connector 945 is mounted on an upper end of a rear surface of the substrate 943. The connector 945 may be connected to a connector (not shown in the drawings) that is provided on the sewing machine 1. An orientation of the receiver 94 is determined by a direction of the opening 941 in relation to the microphone 944.

Figure 5:
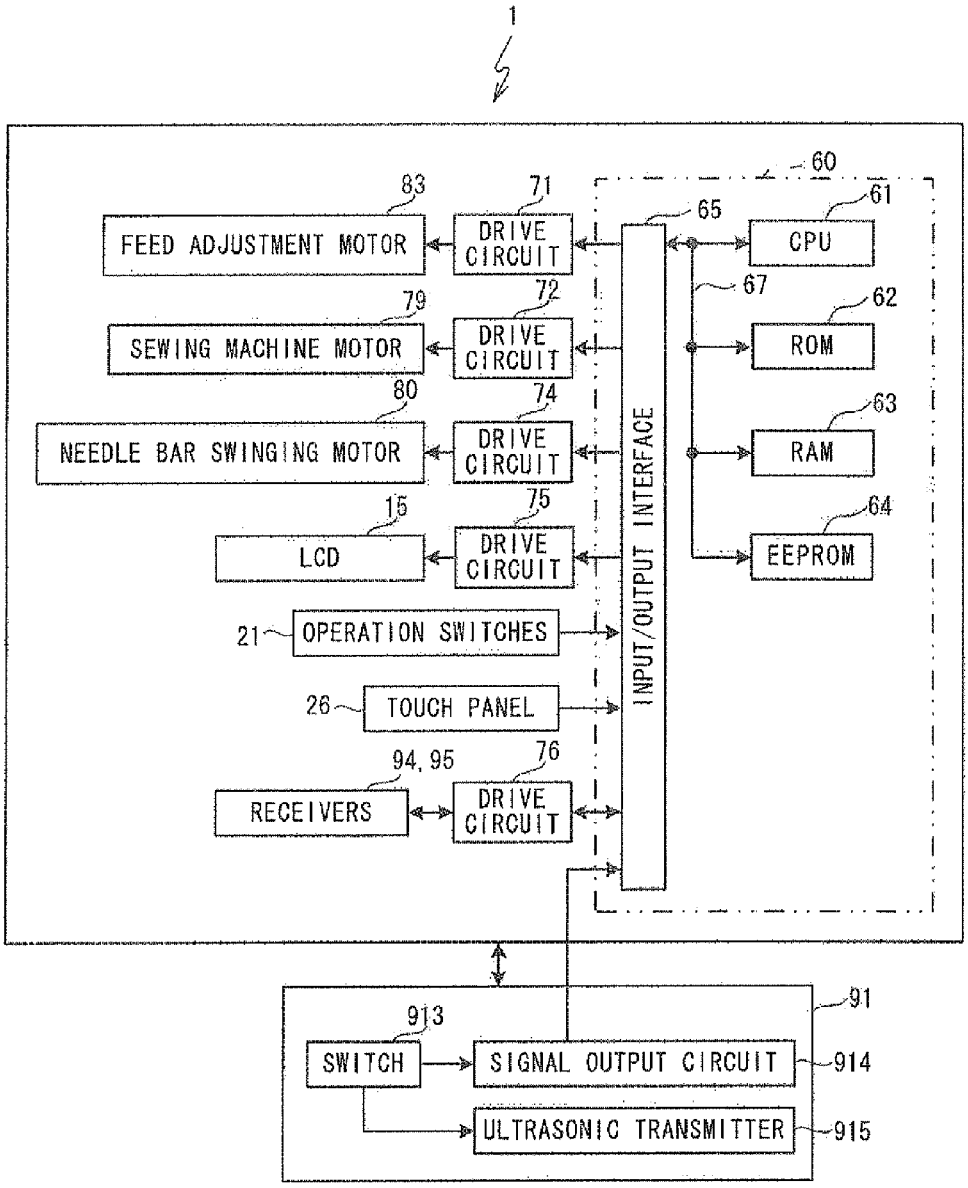
FIG. 5 is a block diagram showing an electrical configuration of the sewing machine and an ultrasonic pen according to the first embodiment.

An electrical configuration of the sewing machine 1 and the ultrasonic pen 91 will be explained with reference to FIG. 5. A control portion 60 of the sewing machine 1 includes a CPU 61, a ROM 62, a RAM 63, an EEPROM 64, and an input/output interface 65, which are mutually connected via a bus 67. The ROM 62 stores programs and data etc. that are used by the CPU 61 to execute processing. The EEPROM 64 stores data of various types of sewing patterns that are used for the sewing machine 1 to perform sewing.

The operation switches 21, the touch panel 26, and drive circuits 71, 72, 74, 75, and 76 are electrically connected to the input/output interface 65. The drive circuits 71, 72, 74, 75, and 76 may respectively drive the feed adjustment motor 83, the sewing machine motor 79, the needle bar swinging motor 80, the LCD 15, the receiver 94, and the receiver 95. The drive circuit 76 includes an amplification circuit. The amplification circuit may amplify ultrasonic signals detected by the receivers 94 and 95, and may transmit the amplified signals to the CPU 61.

The electrical configuration of the ultrasonic pen 91 will be explained. The ultrasonic pen 91 includes the switch 913, the signal output circuit 914, and the ultrasonic transmitter 915. The switch 913 is connected to the signal output circuit 914 and the ultrasonic transmitter 915. The signal output circuit 914 can be connected to the input/output interface 65. The signal output circuit 914 may output an electrical signal to the CPU 61 via the input/output interface 65.

Figure 6:
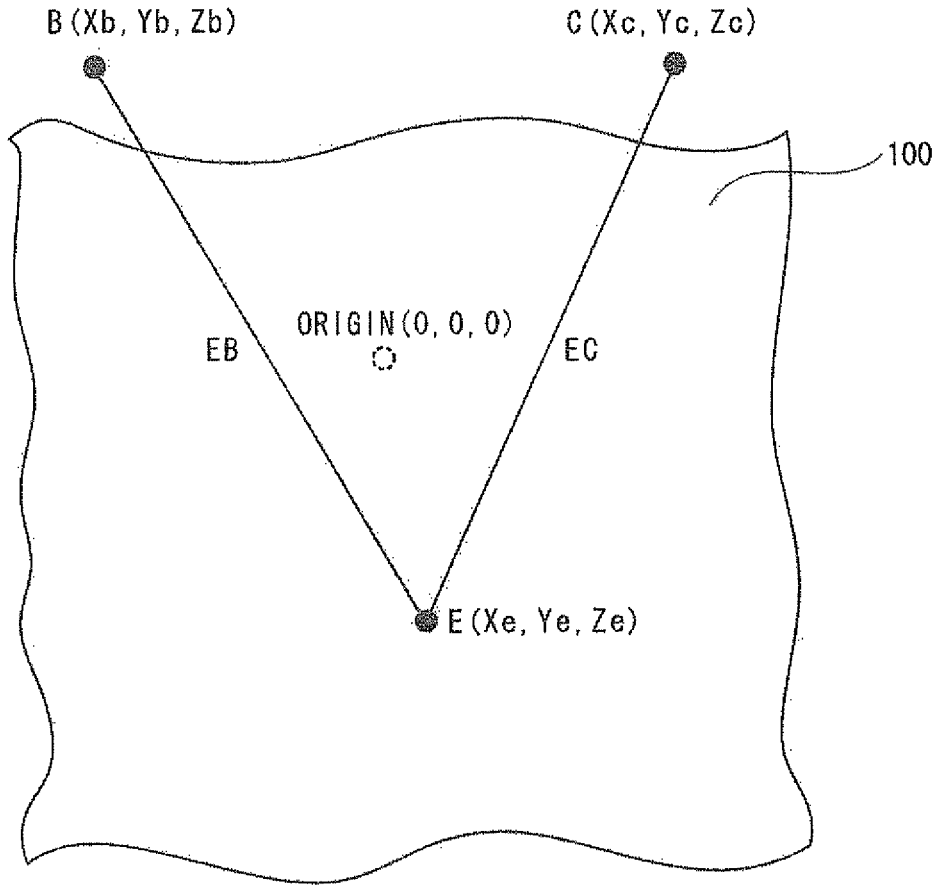
FIG. 6 is a diagram illustrating a calculation method of specified coordinates E according to the first embodiment.

A method of identifying a position on the work cloth 100 specified using the ultrasonic pen 91 will be explained with reference to FIG. 6. The user may cause the pen tip 911 of the ultrasonic pen 91 to touch the work cloth 100, and thereby may specify a position on the work cloth 100 where sewing is to be performed by the sewing machine 1. Hereinafter, a position on the work cloth 100 that is touched by the pen tip 911 of the ultrasonic pen 91 is also referred to as a specified position. As described below, the sewing machine 1 may identify a specified position by identifying a position of a transmission source of an ultrasonic wave. Therefore, strictly speaking, the position of the ultrasonic transmitter 915 provided in the ultrasonic pen 91 is identified, rather than the position on the work cloth 100 touched by the pen tip 911. The pen tip 911 and the ultrasonic transmitter 915 are arranged very close to each other. Therefore, the position of the ultrasonic transmitter 915 may be assumed as the position on the work cloth 100 touched by the pen tip 911, namely, the specified position. Hereinafter, the left-right direction, the front-rear direction, and the up-down direction of the sewing machine 1 are respectively defined as an X direction, a Y direction, and a Z direction. The left-right direction and the up-down direction of FIG. 6 respectively correspond to the X direction and the Y direction. A direction from the near side to the far side corresponds to the Z direction.

The sewing machine 1 identifies the specified position as coordinate information (an X coordinate, a Y coordinate, and a Z coordinate). Here, the coordinate origin (0, 0, 0) is defined as a center point of a needle hole. The needle hole is formed in the needle plate 34 (refer to FIG. 1), and is a hole through which the sewing needle may pass. The center point of the needle hole is a needle drop point, which will be described below. The Z coordinate of a top surface of the needle plate 34 is 0. Coordinates B that indicate the position of the receiver 94 are denoted by (Xb, Yb, Zb). Coordinates C that indicate the position of the receiver 95 are denoted by (Xc, Yc, Zc). Coordinates E that indicate the specified position are denoted by (Xe, Ye, Ze), The Z coordinate of the receivers 94 and 95 indicates the height of the receivers 94 and 95 with respect to the top surface of the needle plate 34. The coordinates B (Xb, Yb, Zb) and the coordinates C (Xc, Yc, Zc) are stored in advance in the ROM 62. Hereinafter, the coordinates E are also referred to as "specified coordinates E". A distance between the specified coordinates E and the coordinates B is referred to as a "distance EB". A distance between the specified coordinates E and the coordinates C is referred to as a "distance EC".

The distances EB and EC can be expressed by the coordinates B, C, and E based on the Pythagorean theorem. The distance EB and the coordinates B, C, and E satisfy a relationship of Formula (1) below. In a similar manner, the distance EC and the coordinates B, C, and E satisfy a relationship of Formula (2) below.

$$(Xb-Xe)^2+(Yb-Ye)^2+(Zb-Ze)^2=(EB)^2 \quad \text{Formula (1)}$$

$$(Xc-Xe)^2+(Yc-Ye)^2+(Zc-Ze)^2=(EC)^2 \quad \text{Formula (2)}$$

Formula (1) is the same as the equation of a spherical surface (whose radius is the distance EB), the origin of which is the coordinates B and on which the specified coordinates E is. In a similar manner, Formula (2) is the same as the equation of a spherical surface (whose radius is the distance EC), the origin of which is the coordinates C and on which the coordinates E is.

The speed at which an ultrasonic wave travels is assumed to be a sonic velocity V. A time required from when the ultrasonic wave is transmitted from the ultrasonic pen 91 at the specified coordinates E to when the ultrasonic wave reaches the receiver 94 is referred to as a propagation time Tb. A time required from when the ultrasonic wave is transmitted from the ultrasonic pen 91 at the specified coordinates E to when the ultrasonic wave reaches the receiver 95 is referred to as a propagation time Tc. In this case, the distances EB and EC are expressed by the following Formulas (3) and (4).

$$EB=V\times Tb \quad \text{Formula (3)}$$

$$EC=V\times Tc \quad \text{Formula (4)}$$

The following Formulas (5) and (6) are obtained by substituting Formulas (3) and (4) into Formulas (1) and (2) described above.

$$(Xb-Xe)^2+(Yb-Ye)^2+(Zb-Ze)^2=(V\times Tb)^2 \quad \text{Formula (5)}$$

$$(Xc-Xe)^2+(Ye-Ye)^2+(Zc-Ze)^2=(V\times Tc)^2 \quad \text{Formula (6)}$$

In Formulas (5) and (6), the coordinates B (Xb, Yb, Zb), the coordinates C (Xc, Yc, Zc) and the sonic velocity V are known values and stored in advance in the ROM 62. The propagation time Tb and the propagation time Tc are each identified by calculating a difference between a transmission timing T1 and a detection timing T2. The transmission timing T1 is a timing at which the ultrasonic wave is transmitted from the ultrasonic transmitter 915 of the ultrasonic pen 91. The detection timing T2 is a timing at which the ultrasonic wave is detected by each of the receivers 94 and 95. The thickness of the work cloth 100 is small enough to be ignored, in comparison to the values Xe and Ye. Therefore, the value Ze of the specified coordinates E (Xe, Ye, Ze) can be deemed to be zero. Thus, the values Xe and Ye can be calculated by solving the simultaneous equations represented by Formulas (5) and (6). Here, taking orientations of the receivers 94 and 95 into account, the specified coordinates E (Xe, Ye, Ze (=0)) on the work cloth 100 that are specified using the ultrasonic pen 91 can be determined.

It is preferable that the receivers 94 and 95 be provided in positions of the sewing machine 1 that satisfy the following conditions (A) to (E). In an explanation of the conditions (A) to (E), the receivers 94 and 95 are referred to as receivers 93 for convenience of the explanation.

(A) An object is unlikely to enter between the ultrasonic pen 91 and the receivers 93.

(B) The receivers 93 are separated from each other to some extent.

(C) The distance, in the X direction and the Y direction, from the needle hole (the origin) of the needle plate 34 to the receivers 93 is large.

(D) The distance from the needle hole (the origin) to the receivers 93 is not extremely large.

(E) The receivers 93 are provided above the top surface of the bed 11. Specifically, the receivers 94 are provided above the work cloth 100 placed on the bed 11.

The reasons are as follows.

The condition (A) is set because if an object enters between the ultrasonic pen 91 and the receivers 93, the receivers 93 may not receive the ultrasonic wave transmitted from the ultrasonic pen 91. The object may be, for example, a hand or an arm of the user. For example, there is a possibility that the hand or the arm enters between the pen tip 911 and the receivers 93 when the user who holds the ultrasonic pen 91 in the user's hand is specifying the specified position. In this case, the ultrasonic wave transmitted from the ultrasonic pen 91 may be shielded by the hand or the arm. Therefore, a case may occur in which the receivers 93 cannot receive the ultrasonic wave. For that reason, it is preferable that the receivers 93 be provided in positions where the hand or the arm of the user does not enter between the ultrasonic pen 91 and the receivers 93 when the user is performing an operation using the ultrasonic pen 91.

The reason for setting the condition (B) is as follows. When the simultaneous equations represented by Formulas (5) and (6) are solved, if the difference between the coordinates B and C is small, the results of Formulas (5) and (6) are close to each other. In this case, an error of the calculated specified coordinates E may become large.

The reason for setting the condition (C) is as follows. As the distance from the origin to the receivers 93 in the X direction and the Y direction increases, the Z-coordinate values of the coordinates B and C become relatively smaller than the X-coordinate values and the Y-coordinate values of the coordinates B and C. Therefore, it is possible to reduce an influence on a calculation result caused by the thickness of the work cloth 100.

The reason for setting the condition (D) is as follows. If the distance from the origin to the receivers 93 is extremely large, the ultrasonic wave transmitted from the ultrasonic pen 91 may be attenuated before the ultrasonic wave reaches the receivers 93. Therefore, it is difficult for the receivers 93 to accurately receive the ultrasonic wave.

The reason for setting the condition (E) is that the pen tip 911 of the ultrasonic pen 91 may come into contact with the top surface of the work cloth 100 that is placed on the bed 11. It is preferable that the receivers 93 can accurately receive the ultrasonic wave transmitted from the ultrasonic pen 91 that is in contact with the top surface of the work cloth 100, Therefore, it is preferable that the receivers 93 be provided above the top surface of the bed 11.

In the first embodiment, as shown in FIG. 1, the receiver 94 is provided at the lower left end of the head 14 and the receiver 95 is provided at the lower right end of the head 14. The position on the work cloth 100 that can be easily specified by the user while the user is holding the ultrasonic pen 91 in the user's hand may be a position on the front side with respect to the needle hole. Thus, the condition (A) is substantially satisfied. The distance between the receivers 94 and 95 is almost the same as the length of the head 14 in the left-right direction. Therefore, the receivers 94 and 95 are sufficiently separated from each other, and the condition (B) is satisfied. The receivers 94 and 95 are provided on the rear side of the lower surface of the head 14. Thus, the distances from the origin to the receivers 94 and 95 in the X direction and the Y direction are larger than when the receivers 94 and 95 are provided substantially in the center, in the front-rear direction, of the lower surface of the head 14. Thus, the condition (C) is satisfied. The distances from the origin to the receivers 94 and 95 are not extremely large. Thus, the condition (D) is satisfied. The receivers 94 and 95 are provided above the top surface of the bed 11. Thus, the condition (E) is satisfied. In this manner, in the first embodiment, the positions in which the receivers 94 and 95 are provided satisfy all the conditions (A) to (E). Therefore, the sewing machine 1 can calculate the specified coordinates E more precisely.

Figure 7:
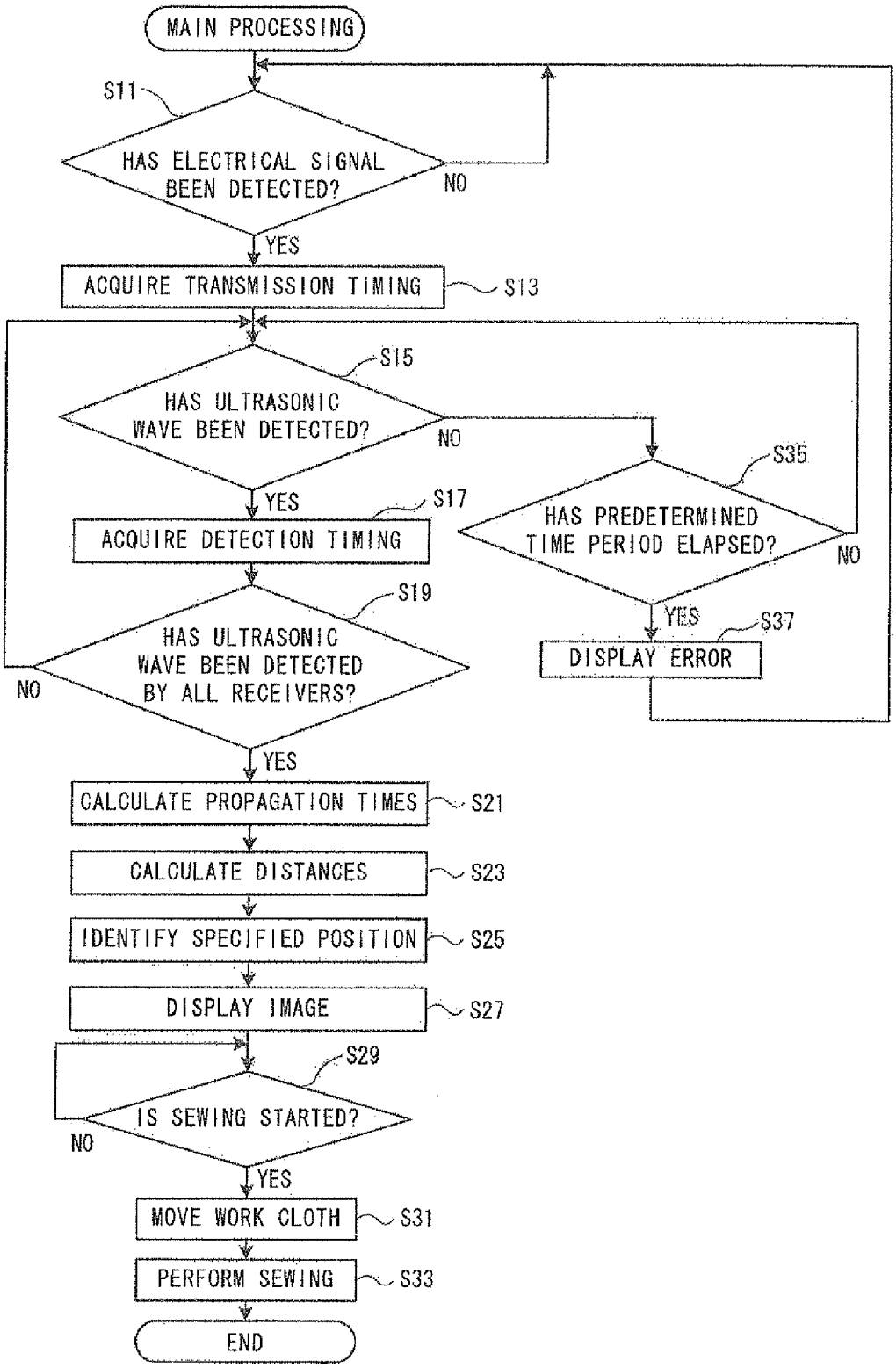
FIG. 7 is a flowchart showing main processing according to the first embodiment.

Processing that is performed by the CPU 61 of the sewing machine 1 to identify the specified position will be specifically explained with reference to FIG. 7. Main processing is performed by the CPU 61 in accordance with the program stored in the ROM 62. For example, when a command to perform sewing is input by a panel operation, the CPU 61 may start the main processing.

The CPU 61 determines whether an electrical signal output from the signal output circuit 914 of the ultrasonic pen 91 has been detected via the cable 912 (step S11). If the electrical signal has not been detected (NO at step S11), the processing returns to step S11. It is assumed that the user specifies an arbitrary position on the work cloth 100 using the ultrasonic pen 91 and the pen tip 911 of the ultrasonic pen 91 comes into contact with the work cloth 100. The pen tip 911 of the ultrasonic pen 91 may be inserted into the pen body 910 and the switch 913 may be turned on. The signal output circuit 914 may output an electrical signal. The CPU 61 may detect the electrical signal (YES at step S11). In a case where the switch 913 of the ultrasonic pen 91 is turned on, the ultrasonic transmitter 915 transmits an ultrasonic wave at the same time as when the signal output circuit 914 outputs the electrical signal. However, the propagation speed of the electrical signal is significantly higher than the propagation speed of the ultrasonic wave, and the electrical signal reaches the CPU 61 substantially at the same timing as the timing at which the switch 913 is turned on.

If the CPU 61 has detected the electrical signal output from the signal output circuit 914 of the ultrasonic pen 91 (YES at step S11), the CPU 61 identifies a time at which the electrical signal is detected. The CPU 61 acquires the identified time as the transmission timing T1 of the ultrasonic wave (step S13). The CPU 61 stores the acquired transmission timing T1 in the RAM 63.

The CPU 61 determines whether the ultrasonic wave transmitted from the ultrasonic pen 91 has been detected via at least one of the receivers 94 and 95 (step S15). If the ultrasonic wave has not been detected via at least one of the receivers 94 and 95 (NO at step S15), the CPU 61 determines whether or not a predetermined time period (for example, one second) has elapsed (step S35). If the predetermined time period has not elapsed (NO at step S35), the processing returns to step S15. The CPU 61 stands by for the predetermined time period until at least one of the receivers 94 and 95 detect the ultrasonic wave.

Here, it is assumed that the ultrasonic wave transmitted from the ultrasonic transmitter 915 of the ultrasonic pen 91 is shielded by, for example, the hand or the arm of the user, the work cloth 100, or the like and does not reach the receivers 94 and 95. In this manner, if the predetermined time period has elapsed without detecting the ultrasonic wave by at least one of the receivers 94 and 95 (YES at step S35), the CPU 61 displays on the LCD 15 an error message indicating that the ultrasonic wave has not been detected (step S37). In a case where the user sees the error message, the user may once again specify an arbitrary position on the work cloth 100 using the ultrasonic pen 91. The processing returns to step S11 to re-detect the electrical signal output from the signal output circuit 914 of the ultrasonic pen 91.

If the CPU 61 detects the ultrasonic wave via at least one of the receivers 94 and 95 within the predetermined time period from the detection of the electrical signal (YES at step S15), the CPU 61 identifies a time at which the ultrasonic wave is detected. The CPU 61 acquires the identified time as the detection timing T2 (step S17). The CPU 61 stores the acquired detection timing T2 in the RAM 63.

The CPU 61 determines whether both the receivers 94 and 95 have detected the ultrasonic wave (step S19). If one of the receivers 94 and 95 has not detected the ultrasonic wave (NO at step S19), the processing returns to step S15. If both the receivers 94 and 95 have detected the ultrasonic wave (YES at step S19), the CPU 61 calculates the propagation time Tb and the propagation time Tc (step S21). The CPU 61 calculates the propagation time Tb and the propagation time Tc by subtracting the transmission timing T1 from the detection timing T2.

The CPU 61 multiplies the calculated Tb and Tc by the sonic velocity V and thereby calculates the distances EB and EC (step S23) (refer to Formulas (3) and (4)). The CPU 61 substitutes the coordinates B (Xb, Yb, Zb), the coordinates C (Xc, Ye, Ze), and the distances EB and EC into Formulas (5) and (6), and solves the simultaneous equations. Thus, the CPU 61 calculates the specified coordinates E (Xe, Ye, Ze (=0)). In this manner, the CPU 61 identifies the position specified using the ultrasonic pen 91, namely, the specified position (step S25).

The CPU 61 displays, on the LCD 15, a display image that shows a relationship between the specified position, which is indicated by the specified coordinates E (Xe, Ye, Ze), and the work cloth 100 (step S27). The CPU 61 determines whether the start/stop switch, which is one of the operation switches 21, has been pressed (step S29). If the start/stop switch has not been pressed (NO at step S29), the processing returns to step S29. If the start/stop switch has been pressed (YES at step S29), the CPU 61 drives the feed dog and moves the work cloth such that the position indicated by the X-coordinate "Xe" and the Y-coordinate "Ye" of the specified coordinates E calculated at step S25 matches the needle drop point (step S31). Then, the CPU 61 starts sewing (step S33). In this manner, sewing is started from the position on the work cloth 100 specified using the ultrasonic pen 91, namely, the specified position. When the sewing is complete, the main processing ends. The needle drop point is a point at which the sewing needle may penetrate the work cloth 100, namely, the center point of the needle hole formed in the needle plate 34.

As explained above, in a case where the user specifies an arbitrary position on the work cloth 100 using the ultrasonic pen 91, the sewing machine 1 can identify the specified position and start sewing. In this manner, the user can easily and appropriately specify a position on the work cloth 100 using the ultrasonic pen 91. The sewing machine 1 can detect the ultrasonic wave using the plurality of receivers 94 and 95, and calculate the specified coordinates E based on the transmission timing T1 and the detection timings T2. Thus, the sewing machine 1 can accurately identify the specified position.

The present disclosure is not limited to the first embodiment and various modifications may be made. The positions in which the receivers 94 and 95 are provided are not limited to the head 14 of the sewing machine 1. For example, the receivers 94 and 95 may be provided on at least one of the presser foot 30 and the presser bar 31. More specifically, the receiver 94 may be provided on the left side of the presser foot 30 or the presser bar 31 and the receiver 95 may be provided on the right side of the presser foot 30 or the presser bar 31.

For example, the receiver 94 may be provided on one of the head 14, the presser foot 30, and the presser bar 31, and the receiver 95 may be provided on the arm portion 13 side of the pillar 12, namely, on any part of a left surface 17 (refer to FIG. 1) of the pillar 12. In this case, the opening 941 of the receiver 95 is provided such that the opening 941 faces to the left. In this case, the distance between the receivers 94 and 95 is larger than when the receiver 95 is provided on the head 14 (refer to condition (B)). The distance, in the X direction and the Y direction, from the needle hole (the origin) of the needle plate 34 to the receiver 95 also increases (refer to condition (C)). Further, the receivers 94 and 95 are provided above the top surface of the bed 11 (refer to condition (E)). In this manner, the positions in which the receivers 94 and 95 are provided satisfy a plurality of conditions included in the conditions (A) to (E), in a similar manner to the first embodiment. Therefore, the sewing machine 1 can precisely calculate the specified coordinates E. Further, particularly in this case, it is possible to increase the distance between the receivers 94 and 95.

The combinations of the positions of the receivers 94 and 95 are not limited to those of the first embodiment and the modified examples described above. In a case where the receivers 94 and 95 are provided on the head 14, the positions of the receivers 94 and 95 are not limited to the rear side of the lower surface of the head 14. For example, the receivers 94 and 95 may be provided on the front side of the lower surface of the head 14, substantially in the center in the front-rear direction of the lower surface of the head 14, or the like. In a case where the receiver 95 is provided on the left surface 17 of the pillar 12, the height at which the receiver 95 is disposed is not particularly limited. However, it is preferable that the receiver 95 be disposed in a lower position in order to reduce an influence caused by approximating the value Ze in Formulas (5) and (6) to zero.

The receivers 94 and 95 may be provided on a part other than the head 14, the presser foot 30, the presser bar 31, and the left surface 17 of the pillar 12. For example, the receivers 94 and 95 may be provided on a lower side surface of the arm 13, a front surface or a rear surface of the head 14, or an upper surface of the bed 11 at the left end of the bed 11. The ultrasonic pen 91 need not necessarily be attached to the sewing machine 1. The sewing machine 1 may detect an ultrasonic wave output from a known device configured to output an ultrasonic wave, and may identify a position of the transmission source of the ultrasonic wave as the specified position.

Second Embodiment

Figure 8:
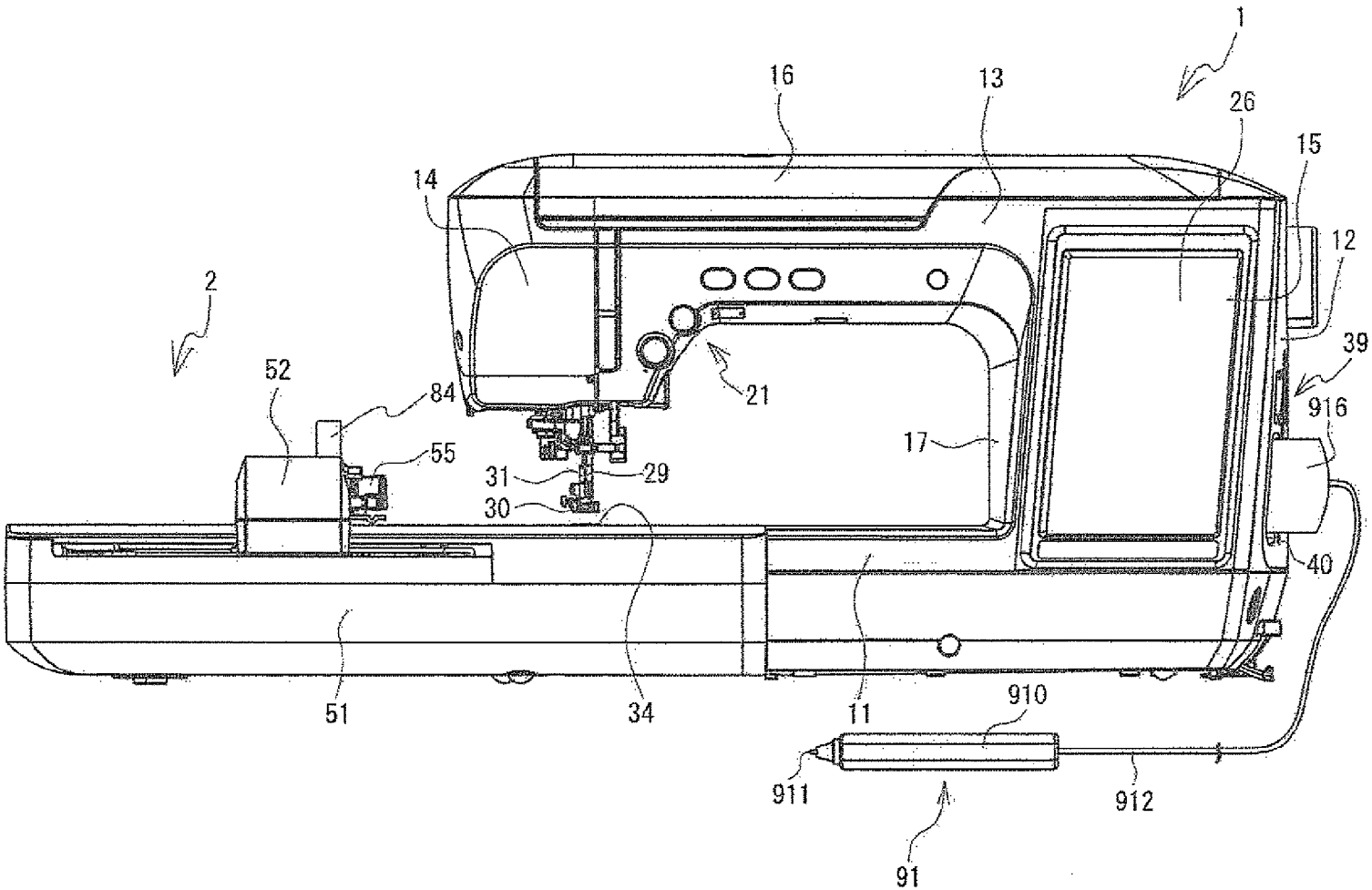
FIG. 8 is a front view of the sewing machine according to a second embodiment.
Figure 9:
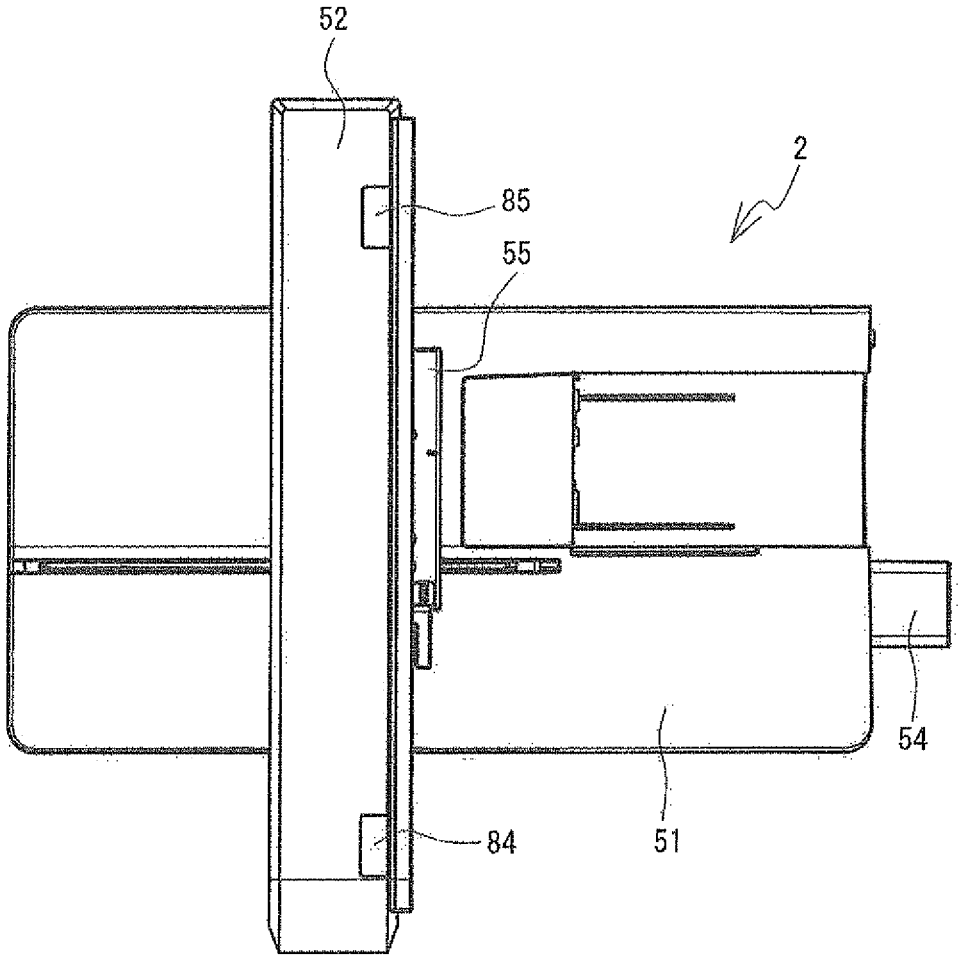
FIG. 9 is a plan view of an embroidery unit according to the second embodiment.
Figure 10:
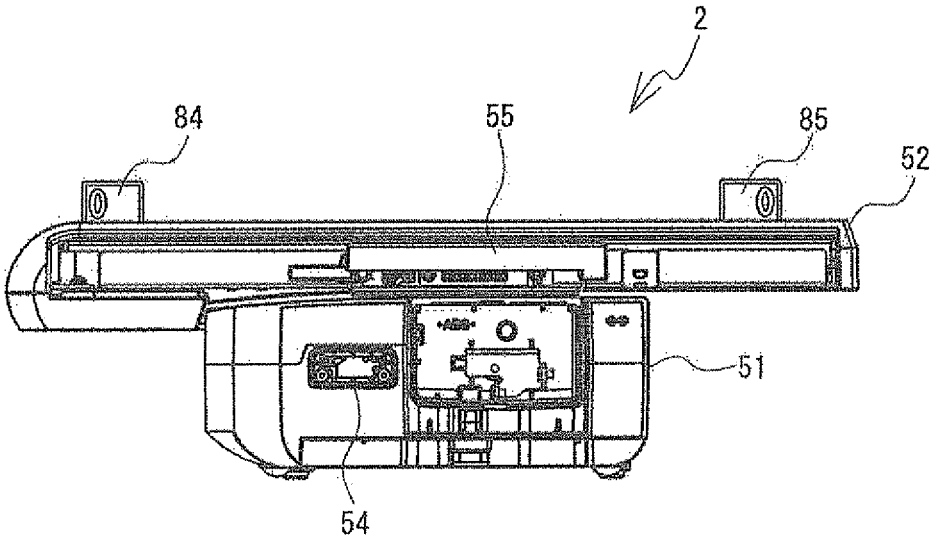
FIG. 10 is a right side view of the embroidery unit according to the second embodiment.

A second embodiment will be explained. In the second embodiment, as shown in FIG. 8 to FIG. 10, receivers 84 and 85 are provided not on the sewing machine 1, but on an embroidery unit 2, which can be attached to and detached from the bed 11 of the sewing machine 1. FIG. 9 and FIG. 10 show the embroidery unit 2 that is not attached to the sewing machine 1. The embroidery unit 2 includes a body portion 51 and a carriage 52.

As shown in FIG. 9 and FIG. 10, a connection portion 54 is provided on a right surface of the body portion 51 of the embroidery unit 2. In a state in which the embroidery unit 2 is attached to the sewing machine 1, the connection portion 54 is connected to a connection receiving portion (not shown in the drawings) of the sewing machine 1, and thus the embroidery unit 2 and the sewing machine 1 are electrically connected.

The carriage 52 is provided on the upper side of the body portion 51. The carriage 52 has a rectangular parallelepiped shape that is long in the front-rear direction. The carriage 52 includes a frame holder 55, a Y axis movement mechanism (not shown in the drawings), and a Y axis motor (not shown in the drawings). The frame holder 55 is a holder to which an embroidery frame (not shown in the drawings) can be detachably attached. The holder 55 is provided on a right surface of the carriage 52. The embroidery frame is a known frame that includes an inner frame and an outer frame. The embroidery frame may clamp and hold the work cloth 100. The work cloth 100 held by the embroidery frame may be arranged on the top surface of the bed 11 and below the needle bar 29 and the presser foot 30. The Y axis movement mechanism may move the frame holder 55 in the front-rear direction (the Y direction). Along with the movement of the frame holder 55 in the front-rear direction, the work cloth 100 held by the embroidery frame may be moved in the front-rear direction. The Y axis motor may drive the Y axis movement mechanism. The CPU 61 (refer to FIG. 5) controls the Y axis motor.

An X axis movement mechanism (not shown in the drawings) and an X axis motor (not shown in the drawings) are provided inside the body portion 51. The X axis movement mechanism may move the carriage 52 in the left-right direction (the X direction). Along with the movement of the carriage 52 in the left-right direction, the work cloth 100 held by the embroidery frame may be moved in the left-right direction. The X axis motor may drive the X axis movement mechanism. The CPU 61 controls the X axis motor.

The receiver 84 is provided at the front end of an upper surface of the carriage 52. The receiver 85 is provided at the rear end of the upper surface of the carriage 52. The receivers 84 and 85 receive are configured to an ultrasonic wave. The receivers 84 and 85 have the same configuration as the receivers 94 and 95. The embroidery frame attached to the frame holder 55 is located at the right of the right surface of the carriage 52, Therefore, the receivers 84 and 85 are located above the position of the carriage 52 where the embroidery frame can be attached. Thus, the receivers 84 and 85 are located above the body portion 51 of the embroidery unit 2. When the embroidery unit 2 is attached to the bed 11 of the sewing machine 1, the receivers 84 and 85 are located above the bed 11. Openings of the receivers 84 and 85 are directed to the right. In a case where the receivers 84 and 85 receive an ultrasonic wave, the receivers 84 and 85 each transmit an electrical signal to the sewing machine 1. The CPU 61 may receive the electrical signals from the receivers 84 and 85, and thereby may detect the ultrasonic wave transmitted from the ultrasonic pen 91.

Processing that is performed by the CPU 61 of the sewing machine 1 to identify the specified position will be explained with reference to FIG. 7. In a case where the CPU 61 detects an electrical signal output from the signal output circuit 914 of the ultrasonic pen 91 via the cable 912 (YES at step S11), the CPU 61 acquires the transmission timing T1 (step S13). In a case where the CPU 61 receives the electrical signal from each of the receivers 84 and 85 (YES at step S15), the CPU 61 identifies a time at which the electrical signal is received from the receiver 84 and a time at which the electrical signal is received from the receiver 85, and acquires the identified times as the detection timings T2 (step S17). The CPU 61 calculates the specified coordinates E and identifies the specified position (steps S21 to S25). The CPU 61 controls the X axis motor and the Y axis motor, and thereby moves the embroidery frame such that the position of the specified coordinates E on the work cloth 100 matches the needle drop point (step S31). Next, the CPU 61 starts sewing on the work cloth 100. The CPU 61 drives the needle bar 29 and the shuttle mechanism (not shown in the drawings) simultaneously with the embroidery frame being moved in the left-right direction (the X direction) and the front-rear direction (the Y direction). The sewing needle attached on the needle bar 29 sews an embroidery pattern on the work cloth 100 held by the embroidery frame. In this manner, the embroidery pattern is sewn in the specified position on the work cloth 100 (step S33).

In the second embodiment, the receivers 84 and 85 are respectively provided at the front end and the rear end of the carriage 52, as shown in FIG. 9 and FIG. 10. Therefore, when the embroidery unit 2 is attached to the bed 11, all the above-described conditions (A) to (E) are satisfied. The ultrasonic wave transmitted from the ultrasonic pen 91 when the pen tip 911 is in contact with the work cloth 100 may be not shielded by the hand or the arm of the user (refer to condition (A)). The distance between the receivers 84 and 85 is separated by a length, in the front-rear direction, of the carriage 52. As a result, the receivers 84 and 85 are sufficiently separated from each other (refer to condition (B)). The distances, in the X direction and the Y direction, from the needle hole (the origin) of the needle plate 34 to the receivers 84 and 85 are larger than when the receivers 84 and 85 are provided on the head 14, the presser foot 30 or the presser bar 31 of the sewing machine 1 (refer to condition (C)). The distances from the origin to the receivers 84 and 85 are not extremely large (refer to condition (D)). The receivers 84 and 85 are provided above the body portion 51 of the embroidery unit 2. Therefore, the receivers 84 and 85 are located above the bed 11 (refer to condition (E)). Specifically, the receivers 84 and 85 are provided above the work cloth 100 held by the embroidery frame. Therefore, the sewing machine 1 can calculate the specified coordinates E more precisely and perform sewing on the work cloth 100. Further, the height from the top surface of the bed 11 to the receivers 84 and 85 is low. If the height from the top surface of the bed 11 to the receivers 84 and 85 is high, there is a possibility that the influence on a calculation result caused by the thickness of the work cloth 100 increases. If the height from the top surface of the bed 11 to the receivers 84 and 85 is low, the influence caused by approximating the value Ze in Formulas (5) and (6) to zero may decrease. Therefore, the error of the calculated specified coordinates E may become small.

In the second embodiment, the receivers 84 and 85 may be provided on a part other than the top surface of the carriage 52. For example, the receiver 84 may be provided on a front surface of the carriage 52 and the receiver 85 may be provided on a rear surface of the carriage 52. For example, the receiver 84 may be provided at the front side of the right surface of the carriage 52, and the receiver 85 may be provided at the rear side of the right surface of the carriage 52.

Third Embodiment

Figure 11:
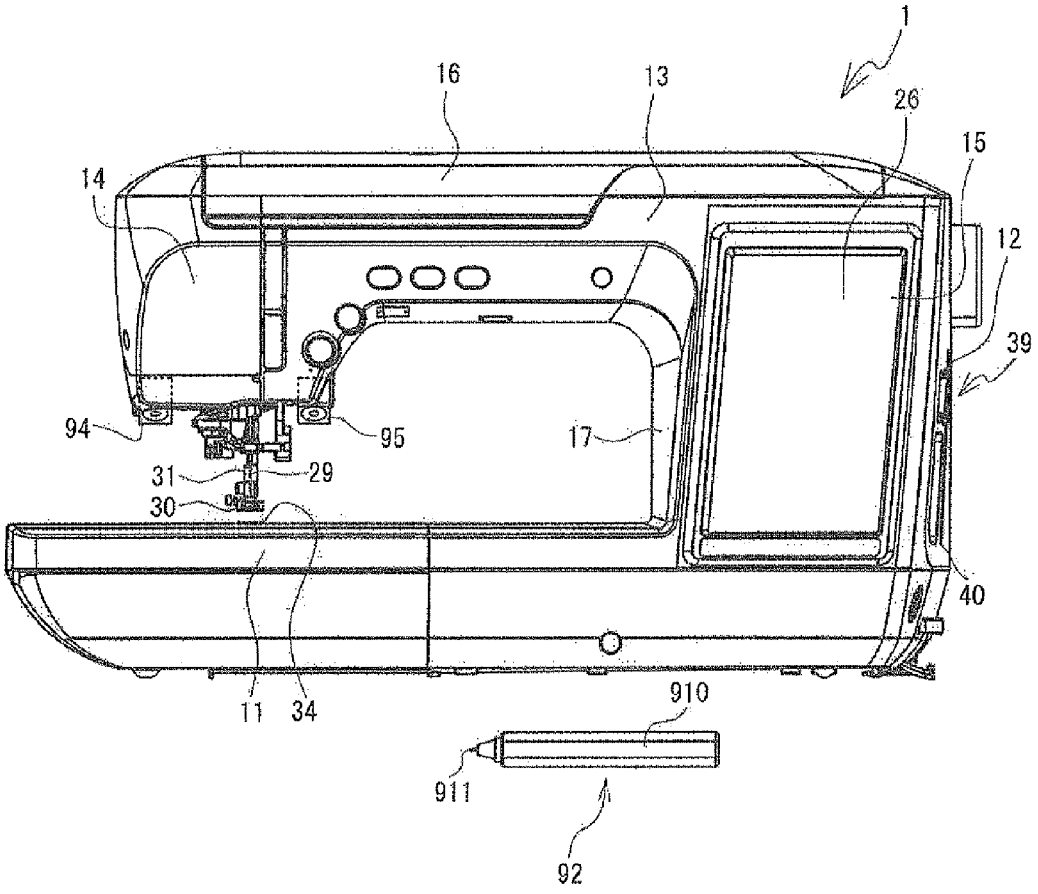
FIG. 11 is a front view of a sewing machine according to a third embodiment.

A third embodiment will be explained. As shown in FIG. 11, the sewing machine 1 of the third embodiment is different from the sewing machine 1 of the first embodiment in that the sewing machine 1 is provided with an ultrasonic pen 92 that is not connected to the sewing machine 1 via a cable. Instead of the signal output circuit 914 (refer to FIG. 5), an electromagnetic wave output circuit 921 (refer to FIG. 12) is provided inside the ultrasonic pen 92. The ultrasonic pen 92 accommodates a battery (not shown in the drawings). The ultrasonic pen 92 may be driven by the battery. The electromagnetic wave output circuit 921 may output an electromagnetic wave signal of a predetermined frequency. When the switch 913 (refer to FIG. 12) is in an OFF state, the electromagnetic circuit 921 does not output the electromagnetic wave signal. When the switch 913 is turned on, the electromagnetic wave output circuit 921 outputs the electromagnetic wave signal. The CPU 61 may receive the electromagnetic wave signal output from the electromagnetic wave output circuit 921 using an electromagnetic wave detector 97 (refer to FIG. 12). The electromagnetic wave detector 97 is provided inside the sewing machine 1. The position of the electromagnetic detector 97 is not limited to the inside of the sewing machine 1 as long as the sewing machine 1 can receive the electromagnetic wave signal.

Figure 12:
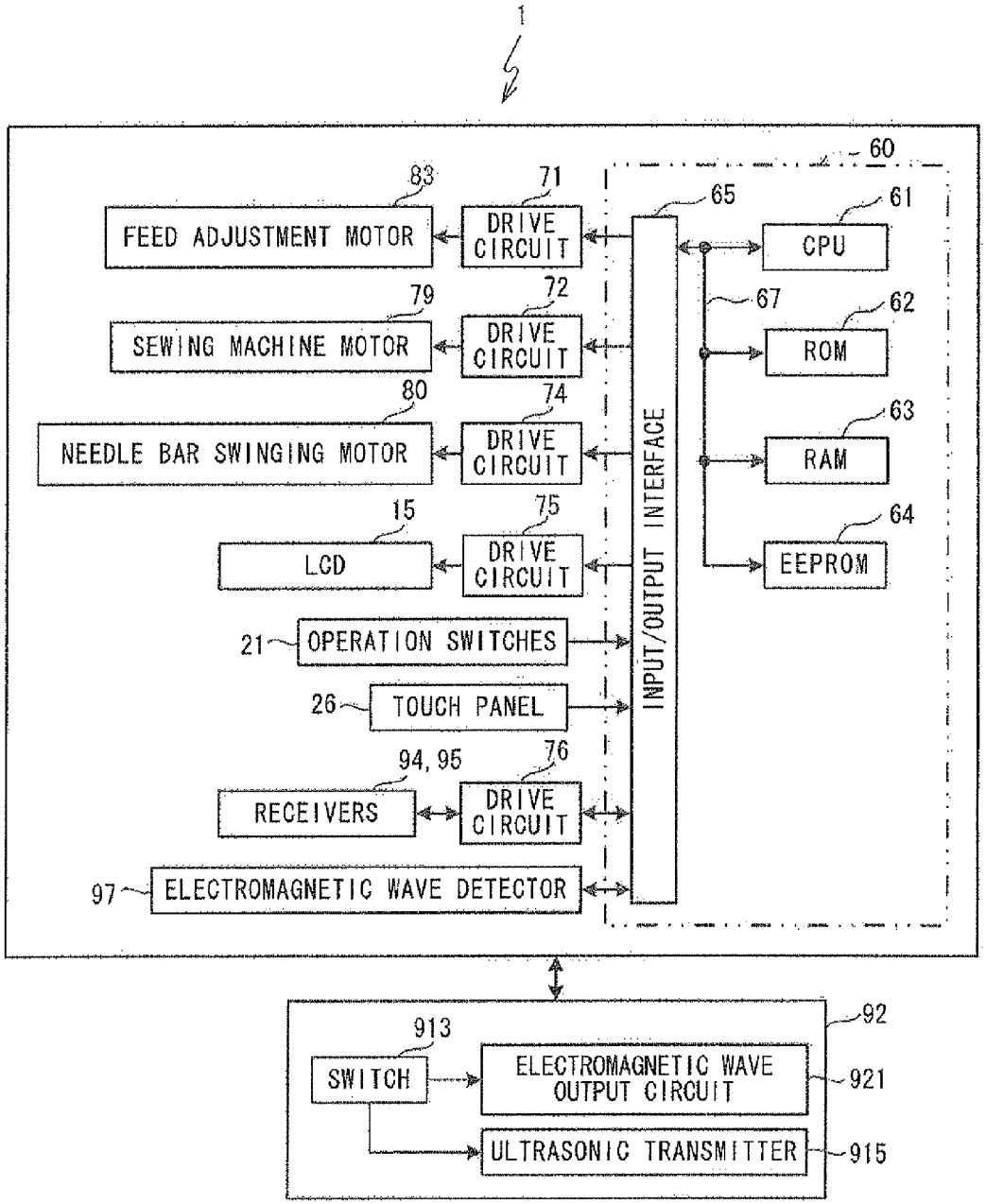
FIG. 12 is a block diagram showing an electrical configuration of the sewing machine and an ultrasonic pen according to the third embodiment.

An electrical configuration of the sewing machine 1 and the ultrasonic pen 92 according to the third embodiment will be explained with reference to FIG. 12. The third embodiment is different from the first embodiment in that the ultrasonic pen 92 includes the electromagnetic wave output circuit 921 and in that the sewing machine 1 includes the electromagnetic wave detector 97. The electromagnetic wave output circuit 921 is connected to the switch 913. The electromagnetic detector 97 is connected to the input/output interface 65. When the electromagnetic wave detector 97 receives the electromagnetic wave signal output from the electromagnetic wave output circuit 921 of the ultrasonic pen 92, the electromagnetic wave detector 97 outputs a signal to the CPU 61 via the input/output interface 65.

Main processing according to the third embodiment will be explained with reference to FIG. 7. At step S11, the CPU 61 determines whether the electromagnetic wave detector 97 has detected the electromagnetic wave signal output from the electromagnetic wave output circuit 921 of the ultrasonic pen 92, instead of detecting the electrical signal output from the signal output circuit 914 of the ultrasonic pen 91 (step S11). If the electromagnetic wave detector 97 has not detected the electromagnetic wave signal (NO at step S11), the processing returns to step S11. If the electromagnetic wave detector 97 has detected the electromagnetic wave signal (YES at step S11), the CPU 61 identifies a time at which the electromagnetic wave signal has been detected. The CPU 61 acquires the identified time as the transmission timing T1 of the ultrasonic wave (step S13). The CPU 61 stores the acquired transmission timing T1 in the RAM 63. Processing from steps S15 to S33 is performed in the same manner as in the first embodiment, and an explanation thereof is omitted here.

As explained above, in the third embodiment, the sewing machine 1 can identify the transmission timing of the ultrasonic wave by detecting the electromagnetic wave signal output by the ultrasonic pen 92. In other words, there is no need to provide a cable to connect the ultrasonic pen 92 and the sewing machine 1. As a result, there is no way the cable can be an obstruction to the operation. Thus, the user can easily specify the specified position on the work cloth 100 using the ultrasonic pen 92.

In the third embodiment, the ultrasonic pen 92 may be provided with a known timer circuit and the timer circuit may be connected to the electromagnetic wave output circuit 921. In this case, the electromagnetic wave output circuit 921 of the ultrasonic pen 92 may output an electromagnetic wave signal that notifies the CPU 61 of the time at which the switch 913 is turned on. The CPU 61 may receive the electromagnetic wave signal via the electromagnetic wave detector 97 and may identify the time notified by the electromagnetic wave signal. The CPU 61 may acquire the identified time as the transmission timing of the ultrasonic wave.

The electromagnetic wave signal output from the electromagnetic wave output circuit 921 may be an electromagnetic wave signal of an arbitrary frequency. For example, the electromagnetic wave signal may be a microwave or infrared light.

Fourth Embodiment

Figure 13:
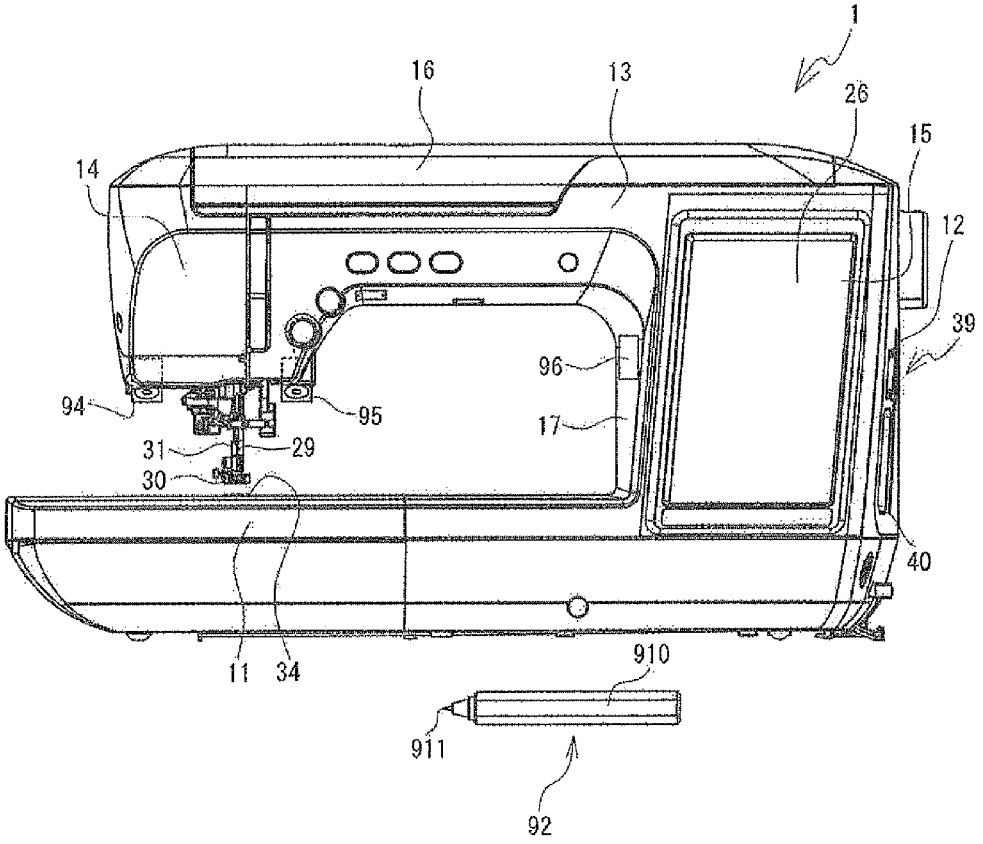
FIG. 13 is a front view of a sewing machine according to a fourth embodiment.

A fourth embodiment will be explained. As shown in FIG. 13, the fourth embodiment is different from the third embodiment in that the sewing machine 1 is provided with a receiver 96 in addition to the receivers 94 and 95 and in that the ultrasonic pen 92 is not provided with the electromagnetic wave output circuit 921, as will be described below in detail. The receiver 96 is provided on the left surface 17 of the pillar 12. The receiver 96 has the same configuration as the receivers 94 and 95. The receiver 96 is provided such that an opening (not shown in the drawings) of the receiver 96 is directed to the left. The CPU 61 may detect the ultrasonic wave using the receivers 94, 95 and 96 and may calculate the specified coordinates E based on the detection timings T2 of the receivers 94, 95 and 96. Unlike the first embodiment to the third embodiment, the CPU 61 does not acquire the transmission timing T1 of the ultrasonic wave, and does not use the transmission timing T1 when calculating the specified coordinates E. An electrical configuration of the sewing machine 1 according to the fourth embodiment is a configuration obtained by removing the electromagnetic wave detector 97 and the electromagnetic wave output circuit 921 from the block diagram shown in FIG. 12 that shows the electrical configuration of the sewing machine 1 according to the third embodiment.

Figure 14:
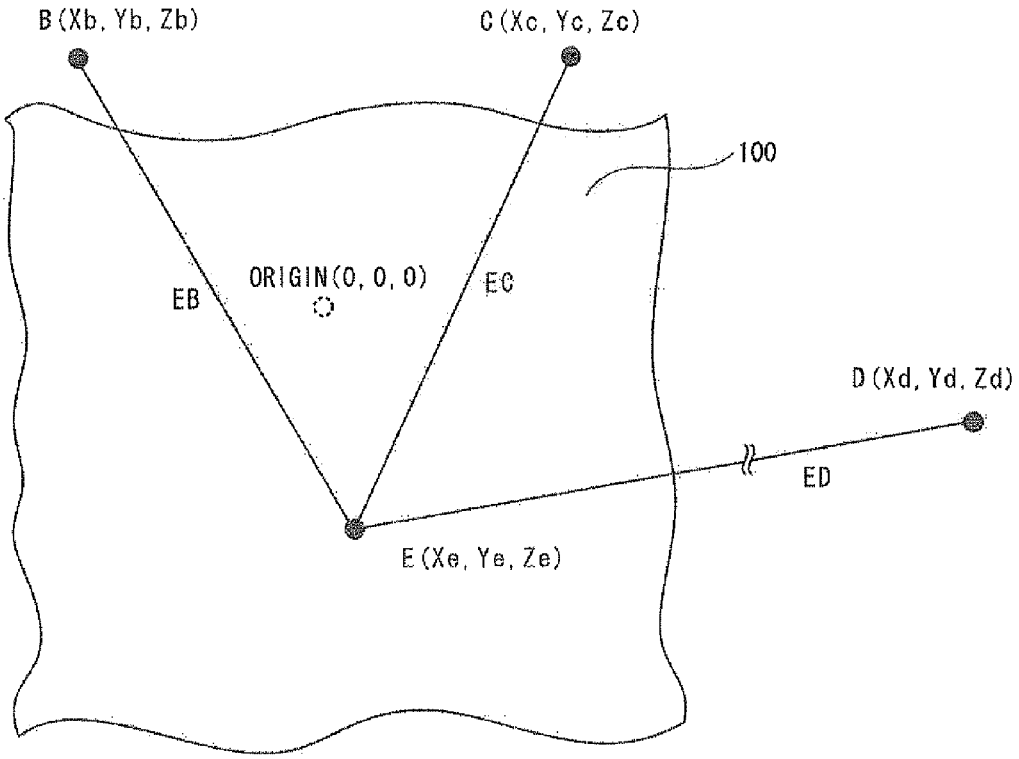
FIG. 14 is a diagram illustrating a calculation method of specified coordinates E according to the fourth embodiment.

A method for identifying a position on the work cloth 100 specified by the ultrasonic pen 92 will be explained with reference to FIG. 14. The may user specify the specified position on the work cloth 100 by causing the pen tip 911 of the ultrasonic pen 92 to touch the work cloth 100. The left-right direction and the up-down direction of FIG. 14 respectively correspond to the X direction and the Y direction. A direction from the near side to the far side of FIG. 14 corresponds to the Z direction. Coordinates D of the receiver 96 are denoted by (Xd, Yd, Zd). A distance between the specified coordinates E and the coordinates D of the receiver 96 is referred to as a "distance ED".

The distance ED can be expressed by the coordinates B, C, D, and E based on the Pythagorean theorem. The distance ED and the coordinates D and E satisfy a relationship of the following Formula (7).

$$(Xd-Xe)^2+(Yd-Ye)^2+(Zd-Ze)^2=(ED)^2 \quad \text{Formula (7)}$$

In the same manner as Formulas (1) and (2) described above, Formula (7) is the same as the equation of a spherical surface (whose radius is the distance ED), the origin of which is the coordinates D and on which the specified coordinates E is.

A time required from when the ultrasonic wave is transmitted from the ultrasonic pen 92 at the specified coordinates E to when the ultrasonic wave reaches the receiver 96 is referred to as a propagation time Td. In this case, the distance ED can be expressed by the following Formula (8).

$$ED=V\times Td \quad \text{Formula (8)}$$

Further, Formulas (4) and (8) can be transformed into the following Formulas (9) and (10).

$$EC=V\times Tc=V\times(Tc-Tb)+V\times Tb \quad \text{Formula (9)}$$

$$ED=V\times Td=V\times(Td-Tb)+V\times Tb \quad \text{Formula (10)}$$

A propagation time difference (Tc−Tb) in Formula (9) is the same as the difference between the detection timing T2 at which the ultrasonic wave is detected via the receiver 95 and the detection timing T2 at which the ultrasonic wave is detected via the receiver 94. In a similar manner, a propagation time difference (Td−Td) in Formula (10) is the same as the difference between the detection timing T2 at which the ultrasonic wave is detected via the receiver 96 and the detection timing T2 at which the ultrasonic wave is detected via the receiver 94. Accordingly, Formulas (9) and (10) can be transformed into the following Formulas (11) and (12). Detection timings at which the ultrasonic wave is detected via the receivers 94, 95, and 96 irrespectively referred to as T2*b*, T2*c* and T2*d*.

$$EC=V\times(T2c-T2b)+V\times Tb \quad \text{Formula (11)}$$

$$ED=V\times(T2d-T2b)+V\times Tb \quad \text{Formula (12)}$$

Following Formulas (13), (14), and (15) can be obtained by substituting Formulas (3), (11), and (12) into Formulas (1), (2), and (7).

$$(Xb-Xe)^2+(Yb-Ye)^2+(Zb-Ze)^2=(V\times Tb)^2 \quad \text{Formula (13)}$$

$$(Xc-Xe)^2+(Ye-Ye)^2+(Zc-Ze)^2=\{V\times(T2c-T2b)+V\times Tb\}^2 \quad \text{Formula (14)}$$

$$(Xd-Xe)^2+(Yd-Ye)^2+(Zd-Ze)^2=\{V\times(T2d-T2b)+V\times Tb\}^2 \quad \text{Formula (15)}$$

In Formulas (13), (14), and (15), the coordinates B (Xb, Yb, Zb), the coordinates C (Xc, Ye, Zc), the coordinates D (Xd, Yd, Zd), and the sonic velocity V are known values and are stored in advance in the ROM 62. The detection timings T2*b*, T2*c* and T2*d* respectively correspond to times at which The CPU 61 detects the ultrasonic wave via the receivers 94, 95, and 96 (step S43, refer to FIG. 15). The value Ze of the specified coordinates E (Xe, Ye, Ze) is deemed to be zero. Based on the above, the values Xe, Ye, and Tb can be calculated by solving the simultaneous equations represented by Formulas (13), (14), and (15). In this manner, the specified coordinates E (Xe, Ye, Ze (=0)) on the work cloth 100 that are specified using the ultrasonic pen 92 are calculated.

Figure 15:
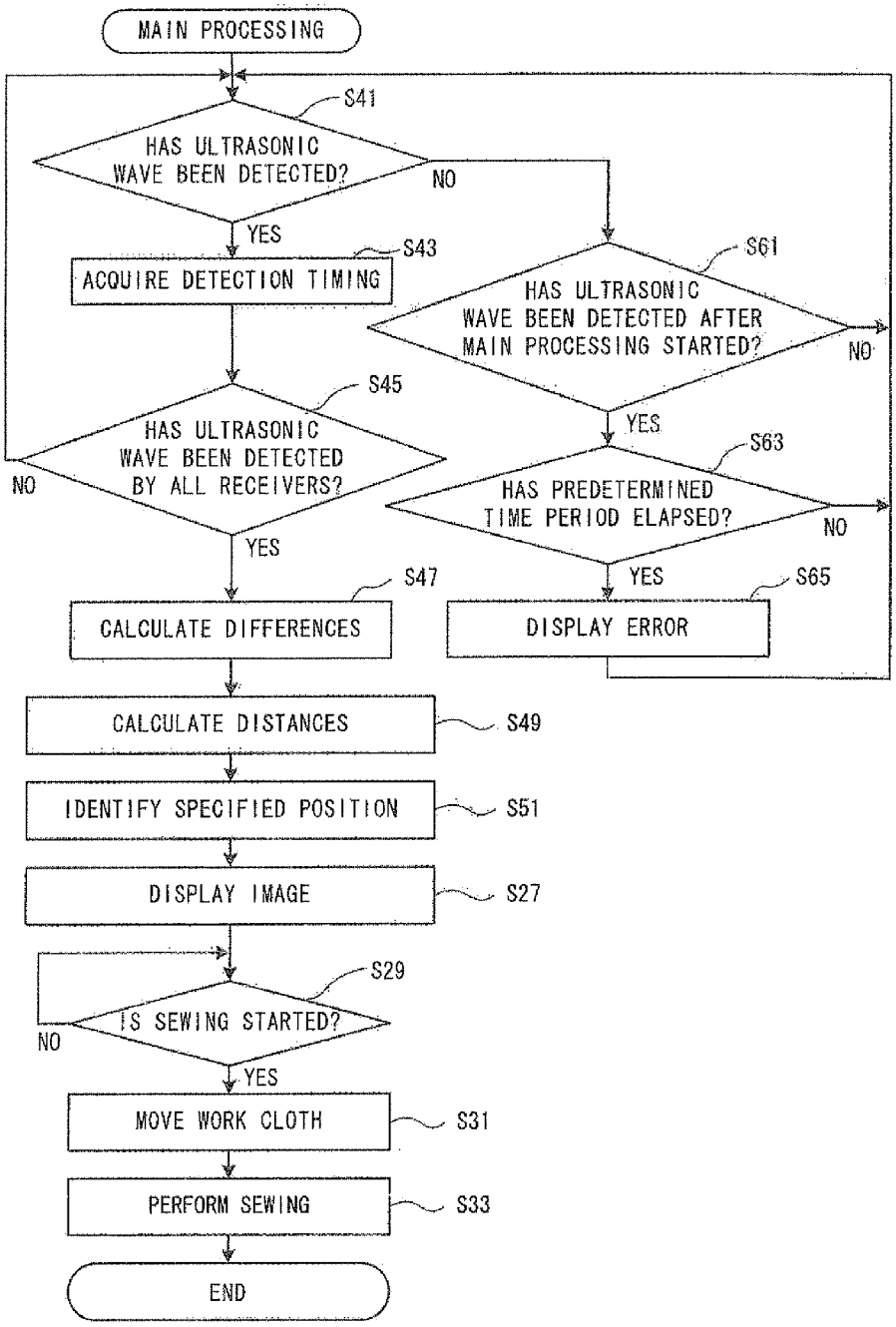
FIG. 15 is a flowchart showing main processing according to the fourth embodiment.

Processing that is performed by the CPU 61 of the sewing machine 1 to identify the specified position will be explained with reference to FIG. 15. The main processing is performed by the CPU 61 in accordance with the program stored in the ROM 62. The CPU61 may start the main processing when, for example, a command to perform sewing is input by a panel operation.

The CPU 61 determines whether at least one of the receivers 94, 95, and 96 has detected the ultrasonic wave transmitted from the ultrasonic pen 92 (step S41). If none of the receivers 94, 95, and 96 has detected the ultrasonic wave (NO at step S41), the CPU 61 determines whether the ultrasonic wave has been detected by at least one of the receivers 94, 95, and 96 after the main processing has been started (step S61). If none of the receivers 94, 95 and 96 has detected the ultrasonic wave after the main processing has been started (NO at step S61), the processing returns to step S41. If the ultrasonic wave has been detected by at least one of the receivers 94, 95, and 96 after the main processing has been started (YES at step S61), the CPU 61 determines whether a predetermined time period (for example, one second) has elapsed from when the ultrasonic wave has been detected for the first time after the start of the main processing (step S63). If the predetermined time period has not elapsed (NO at step S63), the processing returns to step S41. If the predetermined time period has elapsed (YES at step S63), the CPU 61 displays an error message, on the LCD 15, indicating that the ultrasonic wave has not been detected (step S65). The processing returns to step S41.

If at least one of the receivers 94, 95, and 96 has detected the ultrasonic wave within the predetermined time period (YES at step S41), the CPU 61 identifies a time at which the ultrasonic wave has been detected. The CPU 61 acquires the identified time as the detection timing T2 (step S43). The CPU 61 stores the acquired detection timing T2 in the RAM 63.

The CPU 61 determines whether all the receivers 94, 95, and 96 have detected the ultrasonic wave (step S45). If at least one of the receivers 94, 95, and 96 has not detected the ultrasonic wave (NO at step S45), the processing returns to step S41. If all the receivers 94, 95, and 96 have detected the ultrasonic wave (YES at step S45), the CPU 61 calculates differences "T2*c*-T2*b*" and "T2*d*-T2*b*" between the detection timings (step S47). The CPU 61 calculates the distances EB, EC, and ED based on the calculated differences and the propagation time Tb (step S49) (refer to Formulas (3), (11), and (12)). The CPU 61 substitutes the coordinates B (Xb, Yb, Zb), the coordinates C (Xc, Ye, Zc), the coordinates D (Xd, Yd, Zd), and the distances EB, EC, and ED into Formulas (13), (14), and (15), and solves the simultaneous equations. Thus, the CPU 61 calculates the specified coordinates E (Xe, Ye, Ze (=0)). In this manner, the CPU 61 identifies the position specified using the ultrasonic pen 92, namely, the specified position (step S51). Processing from steps S27 to S33 is performed in the same manner as in the first embodiment to the third embodiment (refer to FIG. 7) and an explanation thereof is thus omitted here.

As explained above, in the fourth embodiment, the sewing machine 1 can calculate the specified coordinates E using only the detection timings T2 without using the transmission timing T1, unlike the first embodiment to the third embodiment. Therefore, there is no need to provide structural elements that are necessary to identify the transmission timing T1, such as the signal output circuit 914 (refer to FIG. 5) in the first embodiment, or the electromagnetic wave detector 97 and the electromagnetic wave output circuit 921 in the third embodiment. As a result, in the fourth embodiment, the specified coordinates E can be calculated with a simpler configuration than the configurations of the first embodiment to the third embodiment.

In the fourth embodiment, the three positions in which the receivers 94, 95, and 96 are provided are not limited to the lower left end and the lower right end of the head 14 of the sewing machine 1 and the left surface 17 of the pillar 12. For example, all the receivers 94, 95, and 96 may be provided on the head 14. For example, the receiver 94 may be provided on the rear side of the lower left end of the head 14, the receiver 95 may be provided on the rear side of the lower right end of the head 14, and the receiver 96 may be provided at substantially the center of the front side of the lower end of the head 14.

The receivers 94 and 95 may be provided on the left and right sides of the presser bar 31 or the presser foot 30, and the receiver 96 may be provided on the left surface 17 of the pillar 12. The receiver 96 may be provided on the lower surface of the arm 13.

The receivers 94 and 95 may be provided on the left and right sides of the presser bar 31 or the presser foot 30, and the receiver 96 may be provided at substantially the center, in the left-right direction, of the front side of the lower end of the head 14.

As explained above, the receivers 94, 95, and 96 may be provided on any of the head 14, the presser foot 30, the presser bar 31, the left surface 17 of the pillar 12 and the lower surface of the arm 13. The combinations of the portions of the receivers 94, 95, and 96 are not limited to those of the above-described fourth embodiment and the modified examples.

In a case where the embroidery unit 2 is attached to the sewing machine 1 and used, the receivers 94, 95, and 96 may be provided on the carriage 52 (refer to FIG. 8 to FIG. 10). In this case, the receivers 94 and 95 may be respectively provided at the front end and the rear end of the top surface of the carriage 52, and the receiver 96 may be provided at substantially the center, in the front-rear direction, of the top surface of the carriage 52. The receivers 94 and 95 may be respectively provided at the front end and the rear end of the top surface of the carriage 52, and the receiver 96 may be provided on the rear side of the lower right end of the head 14. The receivers 94 and 95 may be respectively provided at the front end and the rear end of the top surface of the carriage 52, and the receiver 96 may be provided on the left surface 17 of the pillar 12.

Fifth Embodiment

Figure 16:
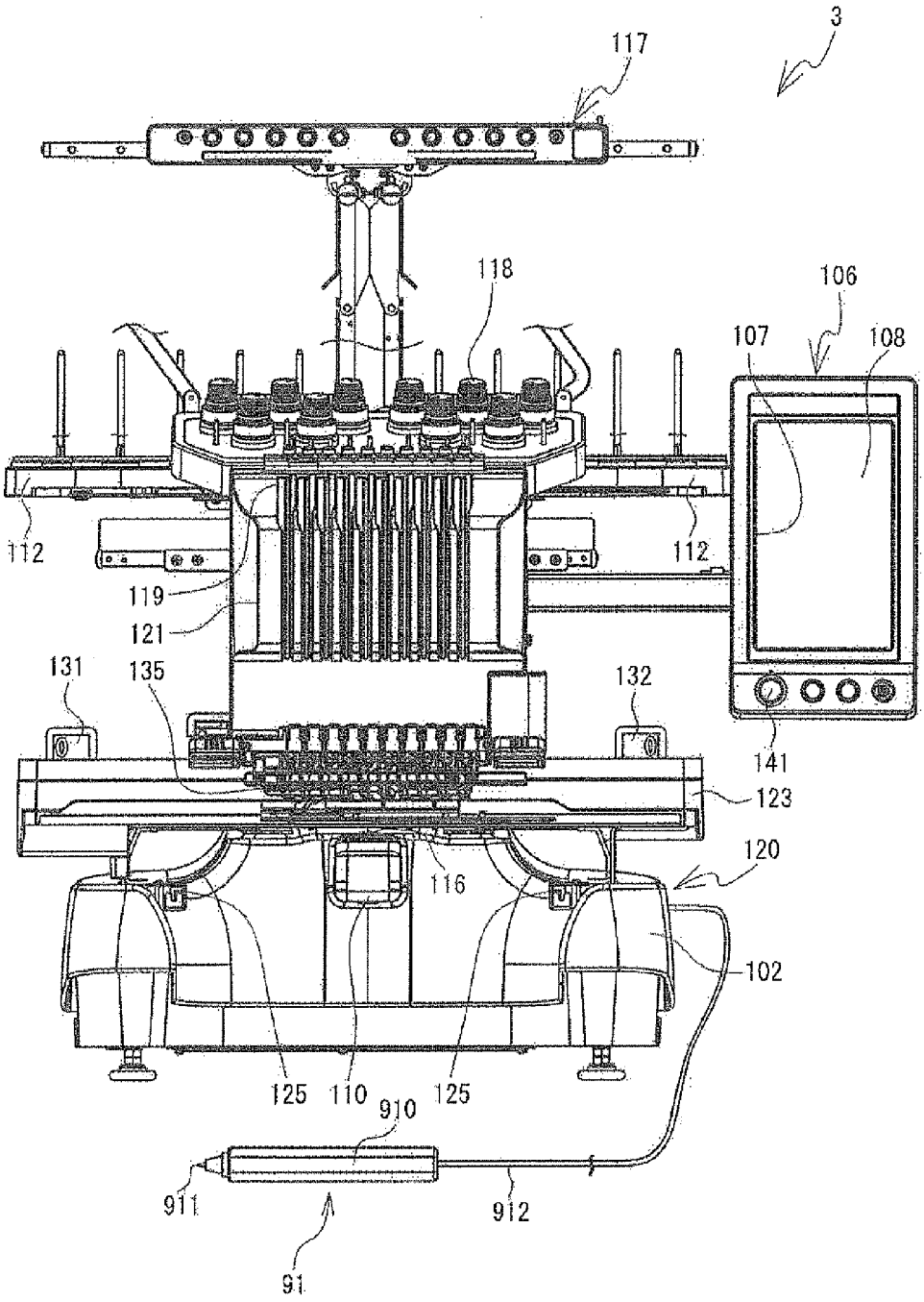
FIG. 16 is a front view of a sewing machine according to a fifth embodiment.

A fifth embodiment will be explained. As shown in FIG. 16, a multi-needle sewing machine 3 (hereinafter referred to as a sewing machine 3) according to the fifth embodiment includes a plurality of needle bars. The sewing machine 3 is provided with receivers 131 and 132. A configuration of the sewing machine 3 will be explained with reference to FIG. 16 to FIG. 18. In the explanation below, it is defined that the upper side, the lower side, the left side, the right side, the near side, and the far side of FIG. 16 are respectively defined as the upper side, the lower side, the left side, the right side, the front side, and the rear side of the sewing machine 3. That is, the direction in which a pillar 103, which will be described below, extends is the up-down direction of the sewing machine 3. The direction in which an arm 104 extends is the front-rear direction of the sewing machine 3.

Figure 17:
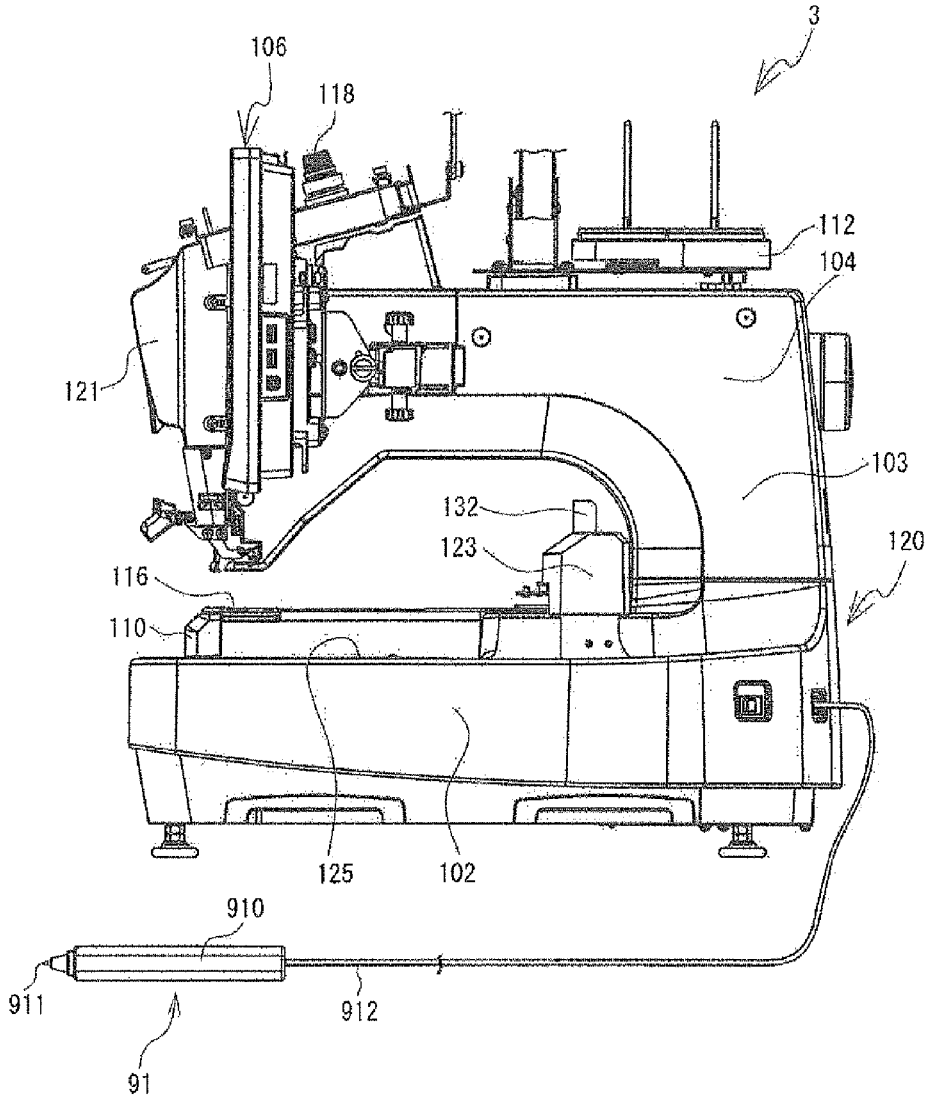
FIG. 17 is a right side view of a multi-needle sewing machine according to the fifth embodiment.

As shown in FIG. 16 and FIG. 17, a main body 120 of the sewing machine 3 includes a support portion 102, the pillar 103, and the arm 104. The support portion 102 is formed in an inverted U shape in a plan view and supports the whole of the sewing machine 3. A left and right pair of guide grooves 125 are provided on a top surface of the support portion 102. The guide grooves 125 extend in the front-rear direction. The pillar 103 extends upward from the rear end of the support portion 102. The arm 104 extends forward from the upper end of the pillar 103. A needle bar case 121 is mounted on the leading end (the front end) of the arm 104 such that the needle bar case 121 can be moved in the left-right direction. Ten needle bars (not shown in the drawings) that extend in the up-down direction are provided inside the needle bar case 121 such that the needle bars are arranged at equal intervals in the left-right direction. One of the ten needle bars that is in a sewing position may be slidingly moved in the up-down direction by a needle bar drive mechanism (not shown in the drawings) that is provided inside the needle bar case 121. A sewing needle 135 can be attached to and detached from the lower end of each of the needle bars.

An operation portion 106 is provided on the right side of a central portion, in the front-rear direction, of the arm 104. The operation portion 106 includes a liquid crystal display (LCD) 107, a touch panel 108, and an operation switch 141. The LCD 107 may display various types of information, such as an operation image that is used for the user to input a command, for example. The touch panel 108 is used to accept a command from the user. The user may perform an operation of pressing the touch panel 108 using a finger or a dedicated touch pen. Hereinafter, this operation is referred to as a "panel operation". The touch panel 108 detects a position pressed by the finger, the dedicated touch pen, or the like, and the sewing machine 3 determines the item that corresponds to the detected position. In this manner, the sewing machine 3 recognizes the selected item. By the panel operation, the user can select or set a pattern to be sewn and various types of conditions, such as sewing conditions. The operation switch 141 is used to command the start or stop of the sewing.

A cylinder bed 110 is provided below the arm 104. The cylinder bed 110 extends forward from the lower end of the pillar 103. A shuttle (not shown in the drawings) is provided inside the leading end (the front end) of the cylinder bed 110. The shuttle may house a bobbin (not shown in the drawings) around which a lower thread (not shown in the drawings) is wound. A shuttle mechanism (not shown in the drawings) is provided inside the cylinder bed 110. The shuttle mechanism (not shown in the drawings) may drive the shuttle. A needle plate 116, which has a rectangular shape in a plan view, is provided on a top surface of the cylinder bed 110. A needle hole (not shown in the drawings), through which the sewing needle 135 may pass, is formed in the needle plate 116.

A left and right pair of thread spool stands 112 are provided at the rear side of a top surface of the arm 104. Ten thread spools (not shown in the drawings), the number of which is the same as the number of the needle bars, can be placed on the pair of thread spool stands 112. A upper thread (not shown in the drawings) may be supplied from a thread spool placed on one of the thread spool stands 112. The upper thread may be supplied to an eye (not shown in the drawings) of the sewing needle 135 that is attached to the lower end of each of the needle bars, via a thread guide 117, a tensioner 118, a thread take-up lever 119, and the like. The ultrasonic pen 91 may be connected to the sewing machine 3 via the cable 912, in the same manner as in the first embodiment.

An embroidery frame movement mechanism 111 (refer to FIG. 18) is provided below the arm 104. The embroidery frame movement mechanism 111 may detachably support an embroidery frame 184 (refer to FIG. 18). Various types of embroidery frames can be used as the embroidery frame 184. The embroidery frame 184 may hold the work cloth 100. The embroidery frame movement mechanism 111 may be driven by an X axis motor (not shown in the drawings) and a Y axis motor (not shown in the drawings), and may move the embroidery frame 184 in the front-rear direction and in the left-right direction.

The embroidery frame movement mechanism 111 will be explained with reference to FIG. 18. The embroidery frame movement mechanism 111 includes a holder 124, an X carriage 122, an X axis drive mechanism (not shown in the drawings), a Y carriage 123, and a Y axis movement mechanism (not shown in the drawings). The holder 124 may detachably support the embroidery frame 184. The X carriage 122 is a plate member that is long in the left-right direction. A part of the X carriage 122 protrudes forward from the front face of the Y carriage 123. The holder 124 is attached to the X carriage 122. The X carriage 122 may move in the left-right direction (the X axis direction) using the X axis motor as a driving source.

The Y carriage 123 has a box shape that is long in the left-right direction. The Y carriage 123 supports the X carriage 122 such that the X carriage 122 can be moved in the left-right direction. The Y axis movement mechanism (not shown in the drawings) is provided with a left and right pair of moving members (not shown in the drawings). The moving members are coupled to lower portions of the left and right ends of the Y carriage 123. The moving members pass through the guide grooves 125 (refer to FIG. 16) in the up-down direction. The moving members may be moved in the front-rear direction (the Y axis direction) along the guide grooves 125, using the Y axis motor as a driving source. The Y carriage 123 coupled to the moving members and the X carriage 122 supported by the Y carriage 123 may be moved in the front-rear direction (the Y axis direction) along with the movement of the moving members. In a state in which the embroidery frame 184 that holds the work cloth 100 is attached to the holder 124, the work cloth 100 is arranged between one of the needle bars and the needle plate 116.

Figure 18:
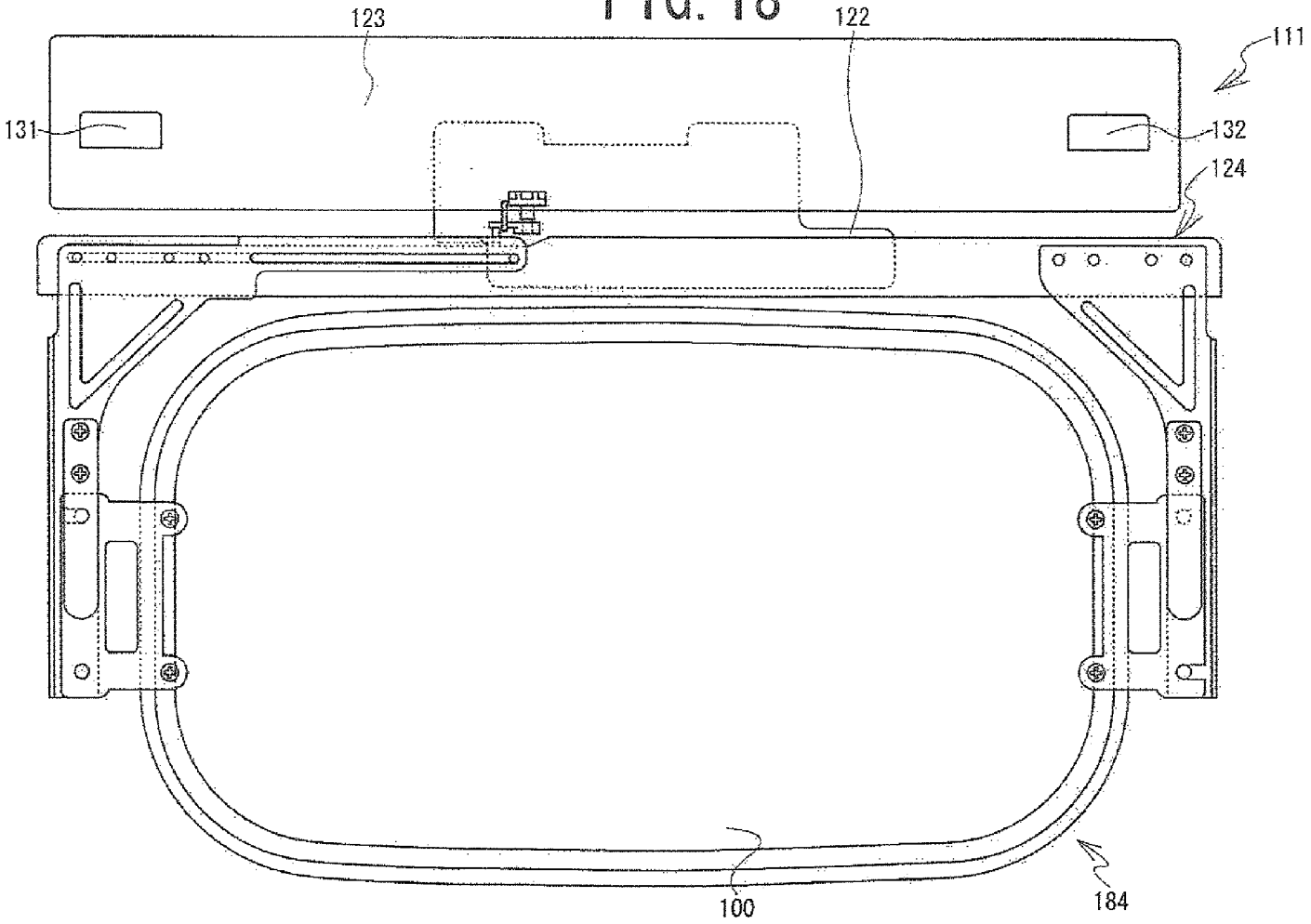
FIG. 18 is a plan view of an embroidery frame movement mechanism according to the fifth embodiment.

As shown in FIG. 16 to FIG. 18, the receiver 131 is provided at the left end of a top surface of the Y carriage 123, and the receiver 132 is provided at the right end of the top surface of the Y carriage 123. The receivers 131 and 132 are configured to receive an ultrasonic wave. The receivers 131 and 132 have the same configuration as the receiver 94. The embroidery frame 184 attached to the folder 124 is located at the front of the Y carriage 123. Therefore, the receivers 131 and 132 are located above the work cloth 100 held by the embroidery frame 184. Openings provided in the receivers 131 and 132 are directed forward.

Processing that is performed by a CPU (not shown in the drawings) of the sewing machine 3 to identify the specified position will be briefly explained with reference to FIG. 7. In a case where the CPU detects an electrical signal output from the signal output circuit 914 of the ultrasonic pen 91 via the cable 912 (YES at step S11), the CPU acquires the transmission timing T1 (step S13). In a case where the CPU detects the ultrasonic wave transmitted from the ultrasonic pen 91 via the receivers 131 and 132 (YES at step S15), the CPU identifies a time at which the ultrasonic wave is detected by the receiver 131 and a time at which the ultrasonic wave is detected by the receiver 132, and acquires the identified times as the detection timings T2 (step S17). The CPU calculates the specified coordinates E and identifies the specified position (steps S21 to S25), In a case where a panel operation is performed to start sewing (YES at step S29), the CPU controls the X axis motor and the Y axis motor and thereby moves the embroidery frame 184 such that the position of the specified coordinates E on the work cloth 100 matches a needle drop point (step S31). The CPU starts sewing on the work cloth 100. The CPU drives the needle bar and the shuttle mechanism simultaneously with the embroidery frame being moved in the left-right direction (the X direction) and the front-rear direction (the Y direction). The sewing needle attached to the needle bar sews an embroidery pattern on the work cloth 100 held by the embroidery frame. In this manner, the embroidery pattern is sewn in the specified position on the work cloth 100 (step S33).

The receivers 131 and 132 are provided on the Y carriage 123. Therefore, the ultrasonic wave that is transmitted from the ultrasonic pen 91 when the pen tip 911 is in contact with the work cloth 100 is unlikely to be shielded by a hand or an arm of the user who uses the ultrasonic pen 91 (refer to condition (A)). The distance between the receivers 131 and 132 is separated by a length, in the left-right direction, of the Y carriage 123. Therefore, the receivers 131 and 132 are sufficiently separated from each other (refer to condition (B)). The distances, in the X direction and the Y direction, from the needle hole (the origin) of the needle plate 116 to the receivers 131 and 132 are large (refer to condition (C)). The distances between the origin and the receivers 131 and 132 are not extremely large (refer to condition (D)). The receivers 131 and 132 are provided above the cylinder bed 110 (refer to condition (E)).

As described above, in the fifth embodiment, the sewing machine 3 is provided with the receivers 131 and 132. The sewing machine 3 can identify the specified position by detecting the ultrasonic wave by each of the receivers 131 and 132. The positions in which the receivers 131 and 132 are provided satisfy all the above-described conditions (A) to (E). Therefore, the sewing machine 3 can calculate the specified coordinates E more precisely and can perform sewing on the work cloth 100. Further, the height from the cylinder bed 110 to the receivers 131 and 132 is sufficiently small. As a result, the influence caused by approximating the value Ze in Formulas (5) and (6) to zero may decrease. Therefore, the error of the calculated specified coordinates E may become small.

In the above-described fifth embodiment, the sewing machine 3 may be provided with the ultrasonic pen 92 that may output an electromagnetic wave signal, instead of the ultrasonic pen 91. The receivers 131 and 132 may be provided in positions other than the Y carriage 123. For example, the receivers 131 and 132 may be provided on a front surface of the pillar 103 and a lower surface of the arm 104.

The sewing machine 3 may be provided with three receivers as in the fourth embodiment. The sewing machine 3 may identify the specified position based only on the detection timings. In this case, the receivers may be provided on any positions on the sewing machine 3, without being limited to the Y carriage 123. For example, the receivers may be provided on the front surface of the pillar 103 and the lower surface of the arm 104.

Sixth Embodiment

The number of the receivers may be one. For example, it is assumed that the one receiver is the receiver 94 that is provided on the left lower end of the head 14. Then, with respect to the coordinates B indicating the position of the receiver 94, specified coordinates indicating the specified position specified by the ultrasonic pen 91 are referred to as coordinates F. At this time, the X coordinates of the coordinates B and the coordinates F are assumed to be the same. To simplify an explanation, Z coordinates are omitted in the following explanation. In other words, the coordinates B are assumed to be (Xb, Yb) and the coordinates F are assumed to be (Xb, Yf). In this case, it is possible to calculate a distance FB between the coordinates F and the coordinates B in the Y direction, based on the propagation time required for the ultrasonic wave transmitted from the ultrasonic pen 91 that is at the coordinates F of the specified position to reach the receiver 94. The coordinates B are known values. Thus, with respect to the needle drop point that is the origin, the Y coordinate "Yf" of the coordinates F of the specified position can be calculated.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a bed;

a pillar that extends upward from the bed;

an arm that faces the bed and that extends from the pillar;

a head that is provided at a leading end of the arm;

a plurality of detecting portions that are provided in different positions on the sewing machine, the plurality of detecting portions being provided above a top surface of the bed, the plurality of detecting portions being provided on at least one of a first section of the head, a second section of the head, a presser bar, and a presser foot, the first section being a section, on an extending side of the arm, of the pillar, the second section being a lower section of the head, the presser bar being provided in a lower portion of the head, the presser foot being attachable to the presser bar, and each of the plurality of detecting portions being configured to detect an ultrasonic wave that has been transmitted from a transmission source;

a processor; and a memory that is configured to store computer-readable instructions that instruct the sewing machine to execute steps comprising:

identifying a position of the transmission source of the ultrasonic wave based on information pertaining to the ultrasonic wave that has been detected by each of the plurality of detecting portions; and controlling sewing based on the position of the transmission source that has been identified.

2. A sewing machine comprising:

a moving portion to which an embroidery frame can be attached and that is configured to move the embroidery frame, the embroidery frame being configured to hold a work cloth;

a plurality of detecting portions that are provided in different positions on the sewing machine, the plurality of detecting portions being provided at positions of the moving portion that are above a position to which the embroidery frame can be attached, and each of the plurality detecting portions being configured to detect an ultrasonic wave that has been transmitted from a transmission source;

a processor; and a memory that is configured to store computer-readable instructions that instruct the sewing machine to execute steps comprising:

identifying a position of the transmission source of the ultrasonic wave based on information pertaining to the ultrasonic wave that has been detected by each of the plurality of detecting portions; and controlling sewing based on the position of the transmission source that has been identified.

3. The sewing machine according to claim 1, wherein the computer-readable instructions further instruct the sewing machine to execute a step comprising acquiring a transmission timing of the ultrasonic wave, and the identifying the position of the transmission source of the ultrasonic wave includes identifying the position of the transmission source of the ultrasonic wave by calculating a distance between the transmission source and each of the plurality of detecting portions, based on the transmission timing that has been acquired and on a detecting timing at which the ultrasonic wave was detected by each of the plurality of detecting portions.

4. The sewing machine according to claim 3, further comprising:

a receiving portion configured to receive an electromagnetic wave signal that indicates the transmission timing of the ultrasonic wave, wherein the acquiring the transmission timing of the ultrasonic wave includes acquiring, as the transmission timing, the transmission timing indicated by the electromagnetic wave signal that has been received by the receiving portion.

5. The sewing machine according to claim 1, wherein the plurality of detecting portions are at least three detecting portions provided in different positions, and the identifying the position of the transmission source of the ultrasonic wave includes identifying the position of the transmission source of the ultrasonic wave by calculating a distance between the transmission source and each of the at least three detecting portions, based on a detection timing at which the ultrasonic wave was detected by each of the at least three detecting portions.

6. The sewing machine according to claim 1, further comprising:

a transmitting portion configured to transmit the ultrasonic wave, wherein each of the plurality of detecting portions is configured to detect the ultrasonic wave that has been transmitted from the transmitting portion, and the identifying the position of the transmission source of the ultrasonic wave includes identifying a position of the transmission portion based on the information pertaining to the ultrasonic wave that has been detected by each of the plurality of detecting portions.

7. A sewing machine comprising:

a bed, a plurality of detecting portions that are provided in different positions on the sewing machine, the plurality of detecting portions being provided above a top surface of the bed, the plurality of detecting portions being provided at positions in an opposite side of a side in which the bed is positioned in relation to a work cloth that is configured to be placed on the bed, and each of the plurality of detecting portions being configured to detect an ultrasonic wave that has been transmitted from a transmission source;

a processor; and a memory that is configured to store computer-readable instructions that instruct the sewing machine to execute steps comprising:

identifying a position of the transmission source of the ultrasonic wave based on information pertaining to the ultrasonic wave that has been detected by each of the plurality detecting portions; and controlling sewing based on the position of the transmission source that has been identified.

8. The sewing machine according to claim 2, wherein the plurality of detecting portions are provided at positions, of the moving portion, above the work cloth held by the embroidery frame.

9. An embroidery unit that can be attached to and detached from a bed of a sewing machine, and to which an embroidery frame can be attached, and that is configured to move the embroidery frame, the embroidery frame being configured to hold a work cloth, the embroidery unit comprising:

a moving portion to which the embroidery frame can be attached and that is configured to move the embroidery frame;

a plurality of detecting portions that are provided in different positions on the embroidery unit, the plurality of detecting portions being provided at positions of the moving portion that are above a position to which the embroidery frame can be attached, and each of the plurality of detecting portions being configured to detect an ultrasonic wave that has been transmitted from a transmission source; and a notifying portion configured to notify the sewing machine of a detection timing at which the ultrasonic wave was detected by each of the plurality of detecting portions, wherein the embroidery unit is configured to move the work cloth based on a position of the transmission source of the ultrasonic wave that has been identified by the sewing machine based on the detection timing that has been notified by the notifying portion.

10. The embroidery unit according to claim 9, wherein the plurality of detecting portions are provided at positions, of the moving portion, above the work cloth held by the embroidery frame.

11. The sewing machine according to claim 2, wherein the computer-readable instructions further instruct the sewing machine to execute a step comprising acquiring a transmission timing of the ultrasonic wave, and the identifying the position of the transmission source of the ultrasonic wave includes identifying the position of the transmission source of the ultrasonic wave by calculating a distance between the transmission source and each of the plurality of detecting portions, based on the transmission timing that has been acquired and on a detecting timing at which the ultrasonic wave was detected by each of the plurality of detecting portions.

12. The sewing machine according to claim 11, further comprising:

a receiving portion configured to receive an electromagnetic wave signal that indicates the transmission timing of the ultrasonic wave, wherein the acquiring the transmission timing of the ultrasonic wave includes acquiring, as the transmission timing, the transmission timing indicated by the electromagnetic wave signal that has been received by the receiving portion.

13. The sewing machine according to claim 2, wherein the plurality of detecting portions are at least three detecting portions provided in different positions, and the identifying the position of the transmission source of the ultrasonic wave includes identifying the position of the transmission source of the ultrasonic wave by calculating a distance between the transmission source and each of the at least three detecting portions, based on a detection timing at which the ultrasonic wave was detected by each of the at least three detecting portions.

14. The sewing machine according to claim 2, further comprising:

a transmitting portion that is configured to transmit the ultrasonic wave, wherein each of the plurality of detecting portions is configured to detect the ultrasonic wave that has been transmitted from the transmitting portion, and the identifying the position of the transmission source of the ultrasonic wave includes identifying a position of the transmission portion based on the information pertaining to the ultrasonic wave that has been detected by the at least one detecting portion.

* * * * *